US009216852B2

(12) United States Patent
Cho et al.

(10) Patent No.: US 9,216,852 B2
(45) Date of Patent: Dec. 22, 2015

(54) LOCKABLE DISPENSING PACKAGE AND ACTUATOR

(75) Inventors: Sean H. Cho, Elgin, IL (US); Peter J. Walters, Barrington, IL (US); Gerald J. Marquardt, Elgin, IL (US); Paul E. Hallman, Lakewood, IL (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 14/123,293

(22) PCT Filed: Aug. 11, 2011

(86) PCT No.: PCT/US2011/047440

§ 371 (c)(1),
(2), (4) Date: Dec. 2, 2013

(87) PCT Pub. No.: WO2013/022452

PCT Pub. Date: Feb. 14, 2013

(65) Prior Publication Data

US 2014/0124539 A1 May 8, 2014

(51) Int. Cl.

| | |
|---|---|
| ***B67B 1/00*** | (2006.01) |
| ***B65D 83/22*** | (2006.01) |
| ***B65D 83/20*** | (2006.01) |

(52) U.S. Cl.

CPC ..... *B65D 83/22* (2013.01); *B65D 83/206* (2013.01)

(58) Field of Classification Search

USPC ..... 222/153.11, 402.11, 402.13

See application file for complete search history.

(56) References Cited

U.S. PATENT DOCUMENTS

| | | | |
|---|---|---|---|
| 3,426,948 | A | 2/1969 | Stirling |
| 3,601,290 | A | 8/1971 | Nigro |
| 3,848,778 | A | 11/1974 | Meshberg |
| 3,860,149 | A | 1/1975 | Hagianis |
| 3,933,283 | A | 1/1976 | Hoagland |

(Continued)

FOREIGN PATENT DOCUMENTS

| | | |
|---|---|---|
| AU | B-49643/93 | 3/1994 |
| EP | 0409497 A1 | 1/1991 |

(Continued)

OTHER PUBLICATIONS

International Search Report and Written Opinion of the International Searching Authority, or the Declaration dated "Jan. 13, 2012" for the International Application No. PCT/US2011/047440 of which the above-captioned instant U.S. patent Application is a U.S. national phase application.

*Primary Examiner* — Donnell Long

(74) *Attorney, Agent, or Firm* — Wood, Phillips, Katz, Clark & Mortimer

(57) ABSTRACT

An actuator (18, 18') is provided for actuating a valve (16) on a container (14) for dispensing a fluent product. The actuator (18, 18') includes an exterior housing (40, 40') and a rotatable member (42, 42'). The rotatable member (42, 42') is located in an interior chamber (48) of the housing (40, 40') and includes an engageable surface (54) located in a circumferentially extending window (50) of the housing (40, 40') to be engaged by a user for movement of the engageable surface (54) within the window (50) between a locked position wherein movement of an actuator button (52) from an un-actuated position to an actuated position is prevented and an unlocked position wherein movement of the actuator button (52) from the un-actuated position to the actuated position is allowed to actuate the valve (16).

8 Claims, 20 Drawing Sheets

(56) References Cited

U.S. PATENT DOCUMENTS

| | | | | |
|---|---|---|---|---|
| 3,937,368 | A | 2/1976 | Hoagland | |
| 4,354,621 | A | 10/1982 | Knickerbocker | |
| 4,418,842 | A | 12/1983 | DiLoreto | |
| 4,542,837 | A | 9/1985 | Rayner | |
| 5,388,730 | A | 2/1995 | Abbott et al. | |
| 6,302,302 | B1 * | 10/2001 | Albisetti | B65D 83/205 222/153.11 |
| 6,523,722 | B1 | 2/2003 | Clark et al. | |
| 6,695,171 | B2 | 2/2004 | Walters et al. | |
| 6,758,373 | B2 | 7/2004 | Jackson et al. | |
| 7,104,427 | B2 * | 9/2006 | Pericard et al. | 222/402.13 |
| 7,487,891 | B2 | 2/2009 | Yerby et al. | |
| 7,861,894 | B2 | 1/2011 | Walters et al. | |
| 2002/0008119 | A1 * | 1/2002 | Clark et al. | 222/153.11 |
| 2003/0168473 | A1 * | 9/2003 | Ho | 222/153.13 |
| 2003/0209569 | A1 * | 11/2003 | Jackson et al. | 222/402.11 |
| 2004/0140324 | A1 | 7/2004 | Meshberg | |
| 2005/0017026 | A1 | 1/2005 | Yerby et al. | |
| 2005/0017027 | A1 | 1/2005 | Yerby et al. | |
| 2006/0201970 | A1 * | 9/2006 | Jasek | 222/153.11 |
| 2007/0039979 | A1 * | 2/2007 | Strand et al. | 222/402.11 |
| 2007/0235474 | A1 | 10/2007 | Downey et al. | |
| 2007/0241134 | A1 * | 10/2007 | Gurrisi et al. | 222/153.11 |
| 2008/0164285 | A1 * | 7/2008 | Hygema | 222/153.11 |
| 2008/0210710 | A1 | 9/2008 | Marquardt et al. | |
| 2009/0050650 | A1 * | 2/2009 | Walters et al. | 222/153.11 |
| 2011/0180570 | A1 | 7/2011 | Campbell | |

FOREIGN PATENT DOCUMENTS

| | | | |
|---|---|---|---|
| EP | WO9933716 | A1 | 7/1999 |
| EP | 1029808 | A1 | 8/2000 |
| EP | 1219547 | E1 | 7/2003 |
| WO | 2010042431 | A1 | 1/1991 |
| WO | WO2007022422 | A2 | 2/2007 |

* cited by examiner

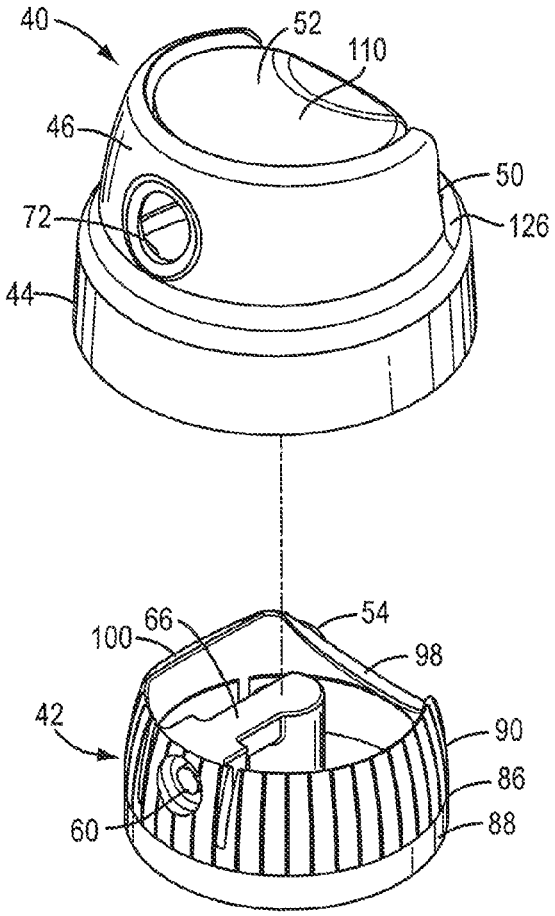
FIG. 8
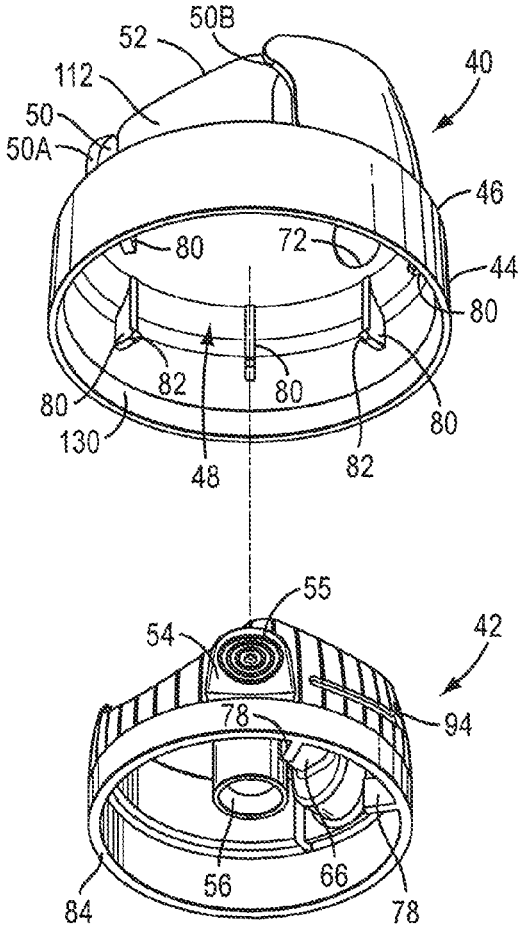
FIG. 9
FIG. 10
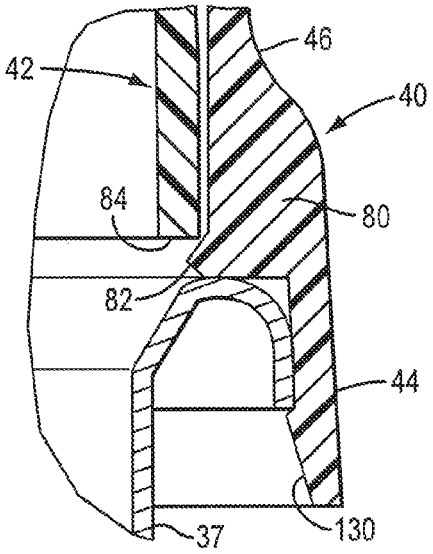

LOCKABLE DISPENSING PACKAGE AND ACTUATOR

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

TECHNICAL FIELD

The present invention relates generally to hand-held dispensing packages for dispensing fluent material, typically a spray or foam, from a pressurized container and to finger-operable actuators used in such dispensing packages. The invention more particularly relates to dispensing packages having an actuator that can be adjusted to selectively permit or prevent actuation of the dispensing package.

BACKGROUND OF THE INVENTION AND TECHNICAL PROBLEMS POSED BY THE PRIOR ART

Finger-operable actuators are typically adapted to be incorporated in dispensing systems mounted on hand-held containers that are commonly used for fluent products. Some actuators are designed for use with a valve assembly and have a suitable discharge structure to produce a foam, mousse, or atomized spray. A dispensing system comprising such a valve assembly and cooperating actuator is typically used for dispensing household products, such as cleaning products, deodorizers, insecticide; and other fluent products, such as cosmetic products or other personal care products such as shaving cream or shaving foam, hair mousse, sun care products, etc., as well as other institutional and industrial products.

Dispensing systems comprising a valve assembly and cooperating actuator are typically mounted at the top of the container, such as a metal can containing the pressurized product. The container, the product and any propellant in the container, the valve assembly, and the actuator all together make up a dispensing package. The actuator typically includes a component that is connected to the valve assembly external of the container and that provides a dispensing flow path or passage from the valve assembly and through which the product can be dispensed to a target area.

For some of these types of fluent products, the dispensing systems may be provided with a mechanism to render the actuator inoperable when the actuator is locked in a particular position which must be released by the user. This insures that the product is not dispensed accidentally during shipping or storage when the actuator might be subjected to inadvertent impact. Some dispensing systems can include a hood, overcap, or other cover that prevents the actuator from being actuated unintentionally during shipping or storage until the hood is subsequently removed from the package by the user.

While conventional dispenser systems such as described above may work well for their intended purpose, there is always room for improvement.

SUMMARY OF THE INVENTION

In accordance with one feature of the invention, an actuator is provided for actuating a valve on a container for dispensing a fluent product. The actuator includes an exterior housing and a rotatable member. The exterior housing has a base to secure the actuator to the container, and further has a shell defining an interior chamber, a circumferentially extending window extending between the interior chamber and an exterior of the shell, and an actuator button movable between an un-actuated position and an actuated position. The rotatable member is located in the interior chamber to rotate relative to the exterior housing between a locked position wherein movement of the actuator button from the un-actuated position to the actuated position is prevented, and an unlocked position wherein movement of the actuator button from the un-actuated position to the actuated position is allowed to actuate the valve. The rotatable member has an engageable surface located in the circumferentially extending window to be engaged by a user for movement of the engageable surface within said window between a first position corresponding to the locked position and a second position corresponding to the unlocked position.

As one feature, the rotatable member includes a stem pocket to receive an outwardly projecting, movable, fluent product-dispensing stem of the valve, and a flow path to direct fluent product from the stem pocket to an exterior of the actuator.

In one feature, the shell has a dispensing port and the flow path has an exit port that is (1) aligned with the dispensing port when the rotatable member is in the unlocked position and (2) circumferentially spaced from the dispensing port when the rotatable member is in the locked position.

According to one feature, the rotatable member further includes a cantilevered arm with the stem pocket and the flow path defined therein. The arm is movable between (1) a neutral position wherein the stem pocket is located so as not to actuate the valve and (2) an actuating position wherein the stem pocket is located to actuate the valve to dispense a fluent product.

As one feature, the arm is biased toward the neutral position.

According to one feature, the actuator button overlies at least part of the cantilevered arm and engages the arm to move the arm from the neutral position to the actuating position when the rotatable member is in the unlocked position and the actuating button moves from the un-actuated position to the actuated position.

As one feature, the actuator button is cantilevered on the shell for movement between the un-actuated and actuated positions.

In one feature, the actuator button is biased toward the un-actuated position.

According to one feature, the rotatable member includes a first stop surface that abuts the actuator button to prevent movement of the actuator button from the un-actuated position to the actuated position when the rotatable member is in the locked position. In a further feature, the rotatable member further includes a second stop surface that abuts the actuator button to prevent movement of the actuator button from the un-actuated position to the actuated position when the rotatable member is in the locked position.

In one feature, the actuator button includes a stop surface, and the rotatable member is situated wherein (1) the first stop surface of the rotatable member underlies the stop surface of the actuator button when the rotatable member is in the locked position and (2) the first stop surface of the rotatable member does not underlie the stop surface of the actuator button when the rotatable member is in the unlocked position.

As one feature, the exterior housing is a one-piece molded component, and the rotatable member is a one-piece molded component.

According to one feature, the rotatable member has a snap fit engagement with the exterior housing.

In one feature, the rotatable member further includes a surface located to contact a surface of at least one of said valve and container in at least the locked position of the rotatable member.

According to one feature of the invention, the actuator is combined with the valve and container.

Other objects, features, and advantages of the invention will become apparent from a review of the entire specification, including the appended claims and drawings.

BRIEF DESCRIPTION OF THE DRAWINGS

FIG. 8 is an enlarged, exploded isometric view from the front and above showing a shell component and a rotatable member component of the actuator of FIG. 1;

FIG. 9 is an enlarged, exploded isometric view from the rear and below showing the actuator components of FIG. 5;

FIG. 10 is a further enlarged, partial cross-sectional view showing a snap fit connection between the shell and the rotatable member components, with the container not shown for ease of illustration;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention are described, along with the container and valve, in a typical (upright) position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

As will be further described in detail, the present invention is directed to a lockable, finger-operable actuator used in dispensing fluent material or product from a container of a dispensing package, such as for dispensing pressurized fluent product from the associated container.

FIGS. 1-6 illustrate a hand-held dispensing package 10 including a pressurized container 14 containing a fluent product, a dispensing valve 16 (shown diagrammatically in FIGS. 5 and 6) in the form of an aerosol dispensing valve or a bag-on-valve dispensing valve (bag not shown), and a finger-operable, locking actuator 18. As will be described more fully below, a user can selectively manipulate the actuator 18 between a locked position (FIGS. 1, 2, and 5) wherein the valve 16 cannot be actuated and an unlocked position (FIGS. 3, 4, and 6) wherein the valve 16 can be actuated (FIG. 7) to dispense the fluent product. In the preferred embodiments illustrated herein, this manipulation can be performed with a single finger, such as with a thumb, of the user while the user is holding the container 14 in the same hand as the single finger used in the manipulation.

Figure 5:
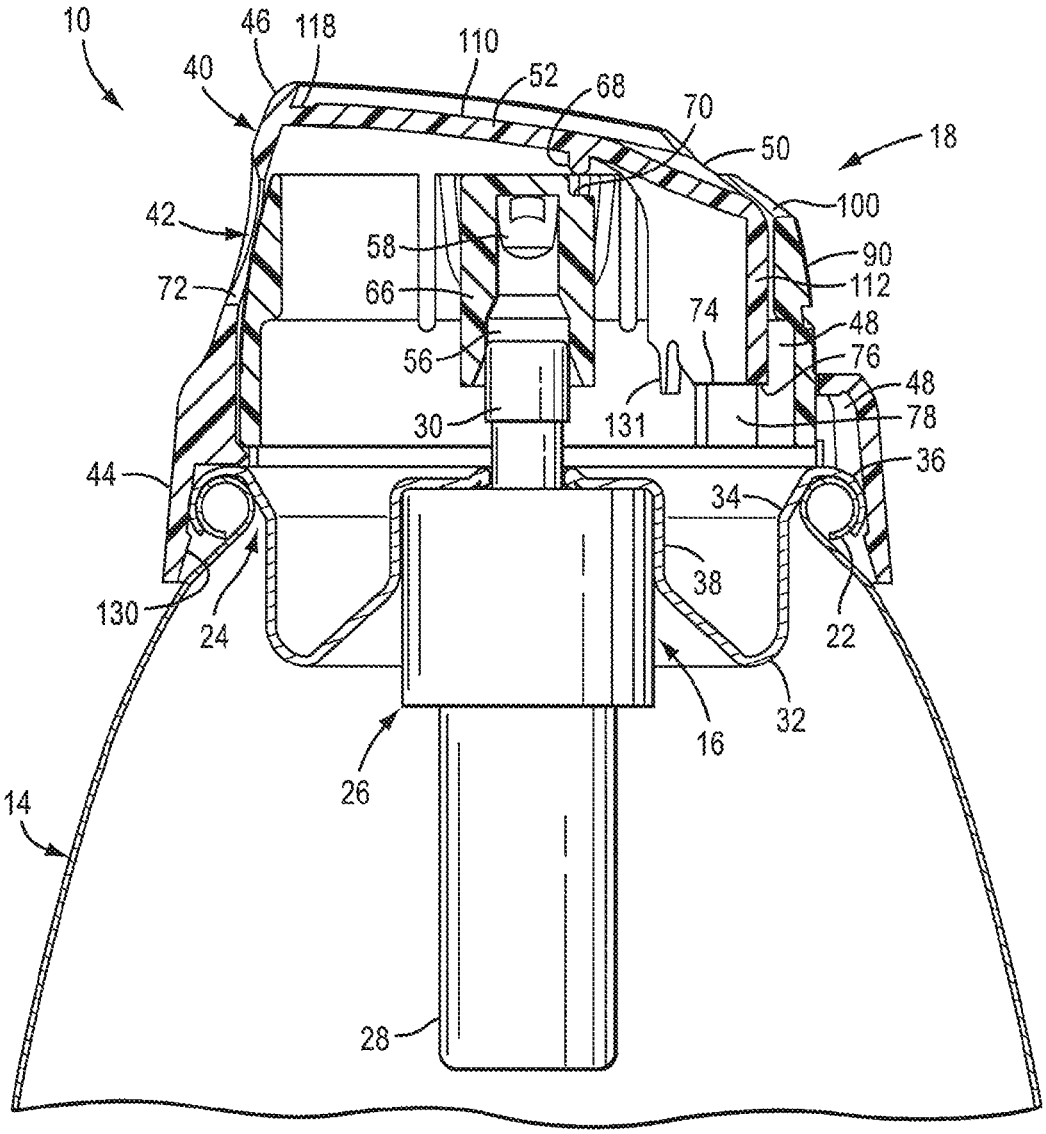
FIG. 5 is an enlarged, fragmentary, cross-sectional view taken along line A-A in FIG. 1, with a diagrammatic representation of a valve body of the dispensing system, and showing the dispensing system in the locked condition preventing actuation.
Figure 6:
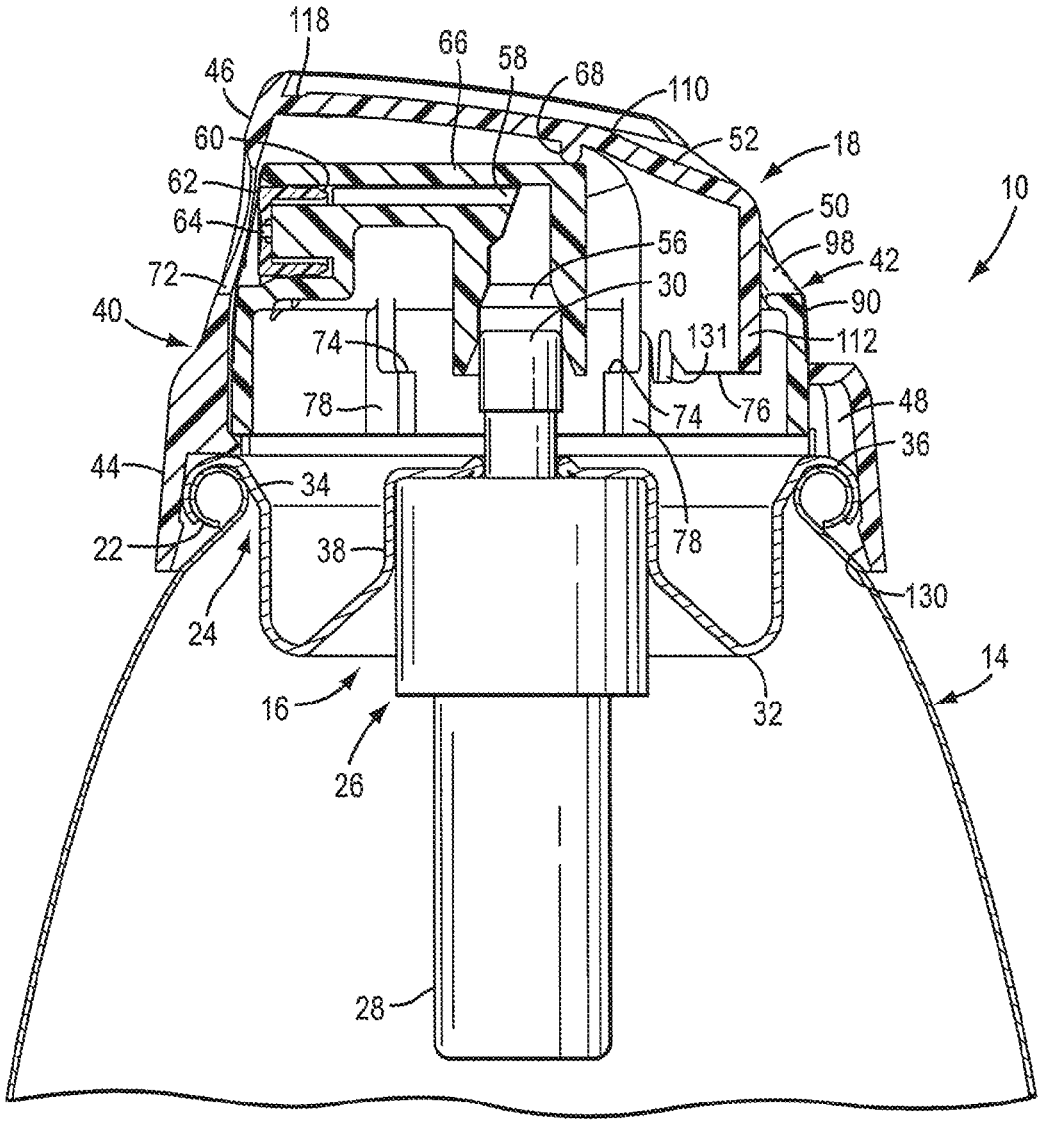
FIG. 6 is an enlarged, fragmentary, cross-sectional view taken along line A-A in FIG. 3, again with the diagrammatic representation of the valve body, and showing the dispensing system in the unlocked condition permitting actuation.

It should be understood that the container 14 and valve 16 can be of any conventional, known construction, and accordingly will only be briefly described herein. The container 14 is typically a metal can having an upper edge rolled into a mounting bead 22 surrounding a container opening 24, as best seen in FIGS. 5 and 6. The container 14 is adapted to hold the fluent product (e.g., a liquid (not shown)) and pressurized gas (not shown) below the dispensing valve 16.

The dispensing valve 16 may be of any suitable conventional or special type. With reference to FIGS. 5 and 6, the dispensing valve 16 will typically include a body 26 containing the working components of the valve 16, with the bottom end 28 of the body 26 being attached to a conventional dip tube (not shown) that directs the fluent product from the container 14 and into the body 26 to be dispensed from the container 14. The upper end of the body 26 is typically a valve stem 30 that projects above the top of the container 14 to be actuated from a closed position (FIGS. 5 and 6) wherein fluent product is not dispensed through the valve 16 and to an open position (FIG. 7) wherein the fluent product is dispensed through the valve 16 via the valve stem 30. Typically, the valve stem 30 is biased to the closed position, such as by a spring (not visible) contained in the valve body 26, so that the valve 16 is normally closed unless forced to the open position by the actuator 18 as it is actuated by a user. After the dispensing valve 16 is actuated to dispense product as atomized spray or foam, the user terminates the actuation operation so that the valve stem 30 is returned by the spring (not visible) to the closed position condition (FIGS. 5 and 6) wherein the valve 16 is closed.

The dispensing valve 16 is mounted to the container 14 by any suitable means. As shown in FIGS. 5 and 6, one such suitable means is a conventional valve mounting cup 32 which has a mounting flange 34 with an outer peripheral portion 36 that can be crimped about the container mounting bead 22 to provide a secure and sealed attachment of the mounting cup 32 to the container 14 at the container opening 24.

The mounting cup 32 includes an annular inner wall 38 which defines an opening through which a portion of the valve body 26 projects, with a portion of the annular inner wall 38 crimped to the exterior of the valve body 26 to provide a secure and sealed attachment of the valve body 26 to the mounting cup 32.

U.S. Published Application Number 2008/0210710 A1, and U.S. Pat. Nos. 7,249,692 and 7,861,894 each show and describe in further detail other suitable forms of valves 16 that can be employed in connection with the present invention.

It will be appreciated that the particular type of the dispenser valve 16 may be of any suitable design for dispensing a product from the container 14 (with or without a dip tube) out through the valve stem 30. The detailed design and construction of the dispensing valve 16 per se forms no part of the present invention. It should further be understood that while the preferred embodiments of the locking actuator 18 are shown herein in connection with an dispensing valve 16, in some applications it may be desirable to utilize an actuator 18 according to the invention with other types of dispensing devices.

Figure 15:
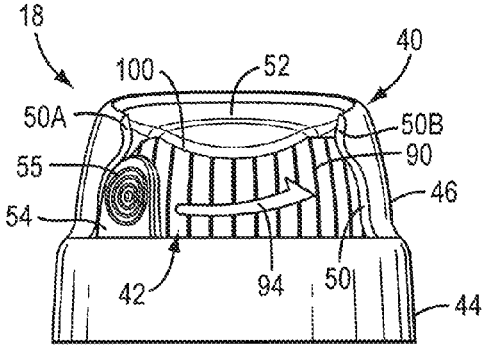
FIG. 15 is a rear elevational view of the actuator of FIGS. 1-10, with the actuator shown in the locked and un-actuated condition.
Figure 16:
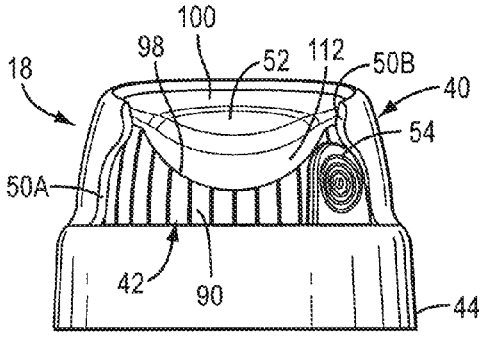
FIG. 16 is a view similar to FIG. 15, but showing the actuator in the unlocked and un-actuated condition.
Figure 17:
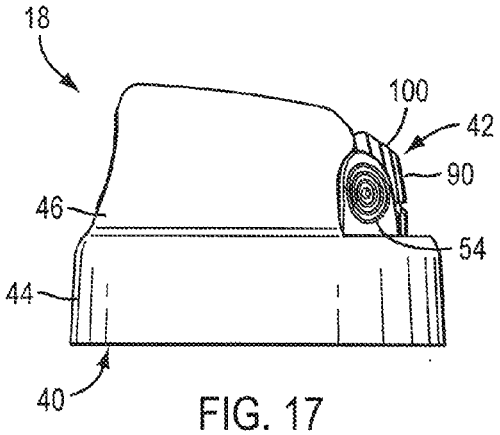
FIG. 17 is a left-side elevational view of the actuator of FIGS. 1-10 (relative to the rear), with the actuator shown in the locked and un-actuated condition.
Figure 18:
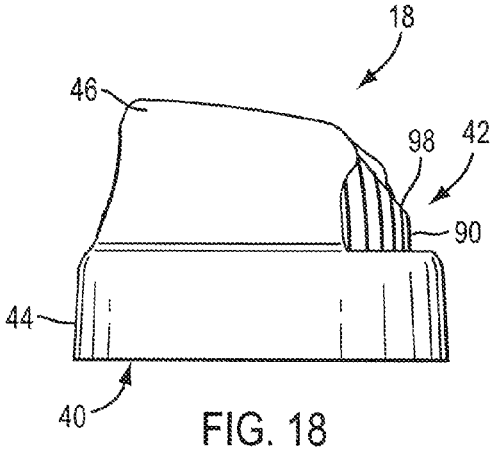
FIG. 18 is a view similar to FIG. 17, but showing the actuator in the unlocked and un-actuated condition.
Figure 19:
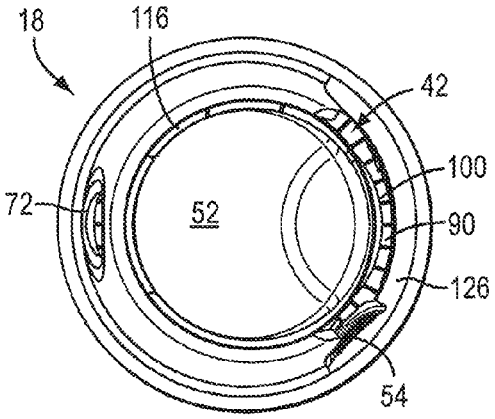
FIG. 19 is a top plan view of the actuator of FIGS. 1-10, with the actuator shown in the locked and un-actuated condition.
Figure 20:
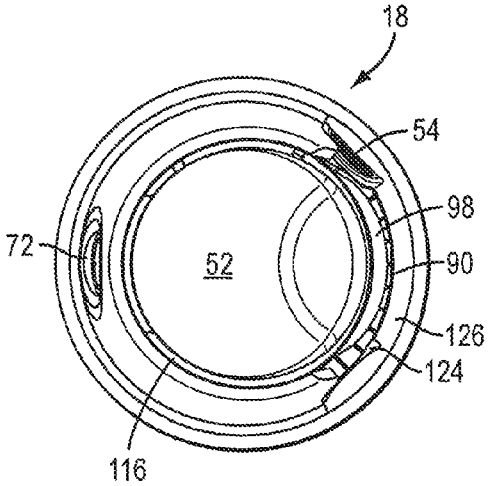
FIG. 20 is a view similar to FIG. 19, but showing the actuator in the unlocked and un-actuated condition.
Figure 21:
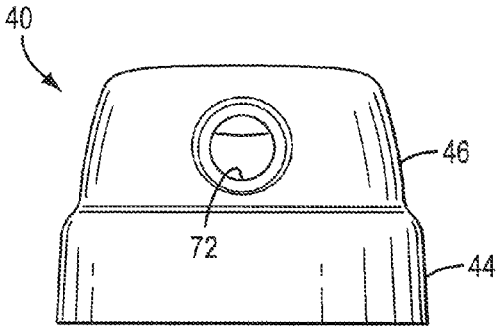
FIG. 21 is a front elevational view of the shell component of the actuator of FIGS. 1-20.

As best seen in FIGS. 5-9, the locking actuator 18 includes an exterior housing 40 and a rotatable member 42. The exterior housing 40 includes a downwardly extending skirt or base 44 to secure the actuator 18 to the container 14. The exterior housing 40 also includes a shell 46 defining an interior chamber 48 (FIGS. 5-7 and 9), a circumferentially extending window 50 extending radially between the interior chamber 48 and an exterior of the shell 46 and circumferentially between side edges 50A and 50B (FIG. 22) of the shell 46, and an actuator button 52 movable between an un-actuated position (shown in FIGS. 5, 6, 8, 9) and an actuated position (shown in FIG. 7). The rotatable member 42 is located in the interior chamber 48 to rotate relative to the exterior housing between a locked position (FIGS. 1, 2, 5) wherein movement of the actuator button 52 from the un-actuated position to the actuated position is prevented to an unlocked position (FIGS. 3, 4, 6, 7) wherein movement of the actuator button 52 from the un-actuated position (FIGS. 3, 4, 6) to the actuated position (FIG. 7) is allowed to actuate the valve 16. To enable the above rotation of the rotatable member 42 by a user, the rotatable member 42 has an engagable surface 54 located in the circumferentially extending window 50 to be engaged by a user for movement between a first position (best seen in FIGS. 2, 15, 19) corresponding to the locked position and a second position (best seen in FIGS. 4, 16, 20) corresponding to the unlocked position. In the illustrated embodiments, the engagable surface 54 is especially adapted for engagement by the finger of a user, such as a thumb or index finger, and has a concave shape with a textured pattern formed on the surface 54 as a series of raised, concentric, circular beads 55. It will be appreciated that there are many possible configurations for the engagable surface 54 and that in some applications a concave shape and/or a textured pattern may not be desired. Preferably, the rotatable member 42 is mounted to rotate about a vertical axis centered on the valve body 26 and stem 30.

Figure 7:
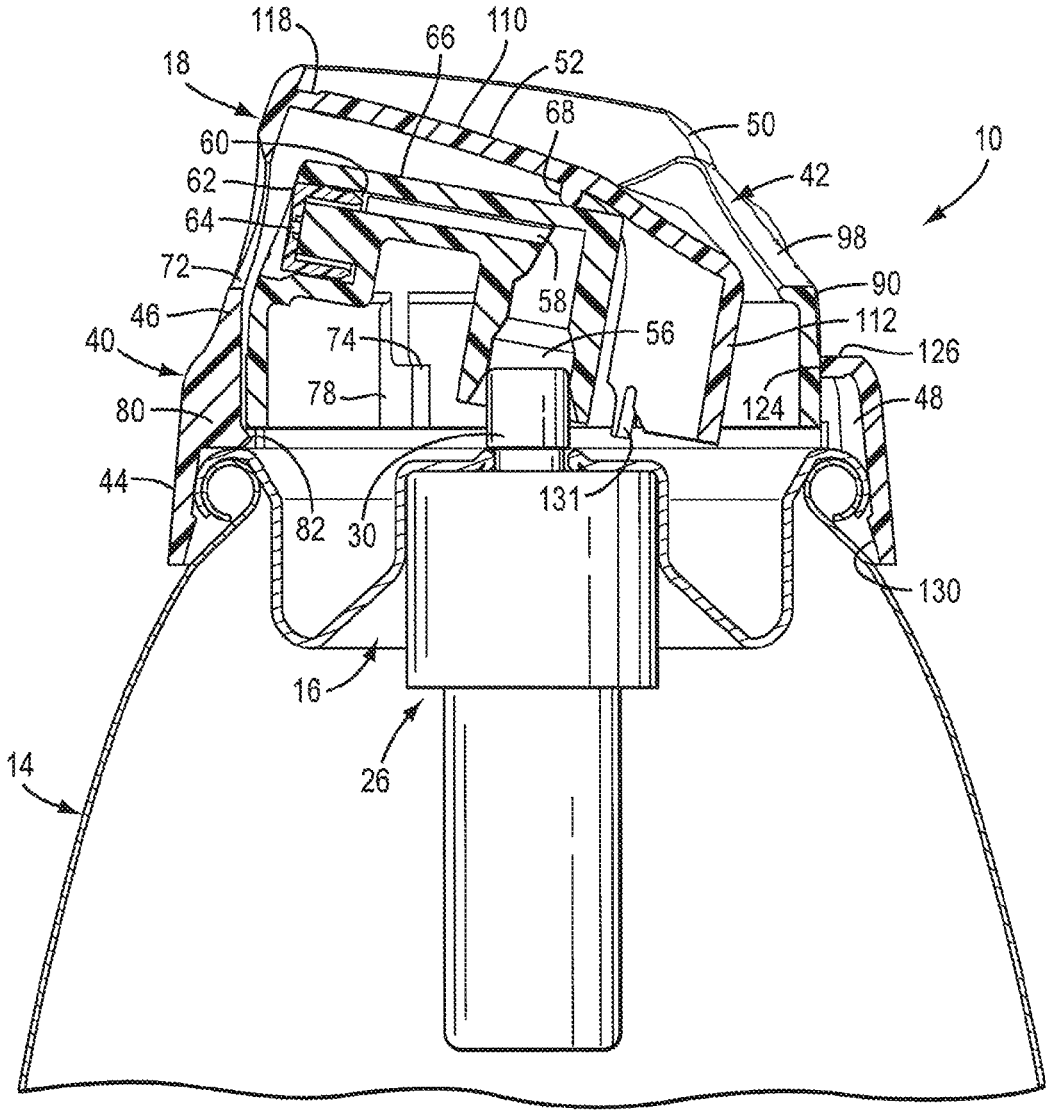
FIG. 7 is a view similar to FIG. 6, but showing the actuator in an unlocked and actuated condition and the valve body in an actuated condition.

As best seen in FIGS. 6 and 7, the rotatable member 42 preferably includes a stem pocket 56 to receive the valve stem 30, and a flow path 58 to direct fluent product from the valve stem 30 and the stem pocket 56 to an exterior of the actuator 18. In this regard, the flow path 58 extends laterally to an exit port 60, which in the illustrated embodiment has an annular configuration into which can be press-fit a conventional mechanical breakup unit (MBU) or spray insert 62 having an exit orifice 64 (shown in FIGS. 6 and 7, but not shown in FIG. 8). The rotatable member 42 also preferably includes a cantilevered arm 66 with the stem pocket 56 and flow path 58 defined therein, as best seen in FIGS. 6-8. The arm 66 is movable between a neutral position (FIGS. 5, 6, 8 and 9) wherein the stem pocket 56 is located so as not to actuate the valve 16 and an actuating position (FIG. 7) wherein the stem pocket 56 is located to actuate the valve 16 to dispense a fluent product. The arm 66 is biased to the neutral position, which in the illustrated embodiment is the as-molded condition or as-formed condition of the rotatable member 42 including the arm 66.

Figure 25:
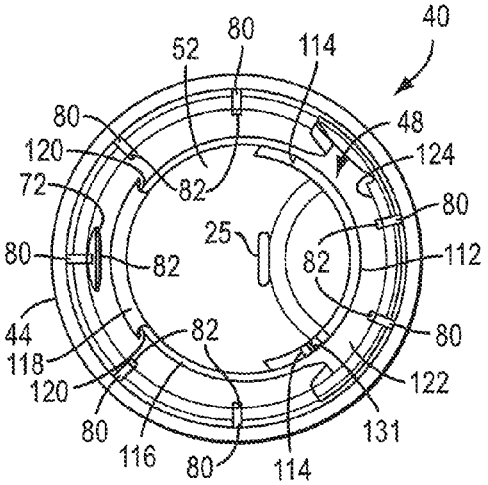
FIG. 25 is a bottom view of the shell component.

As best seen in FIGS. 6 and 7, the actuator button 52 overlies at least part of the arm 66 and engages the arm 66 to move the arm 66 from the neutral position (FIG. 6) to the actuating position (FIG. 7) when the rotatable member 42 is in the unlocked position and the actuating button 52 is moved from the un-actuated position (FIG. 6) to the actuated position (FIG. 7) by a finger, such as a thumb or index finger, of a user. In this regard, as best seen in FIGS. 6, 7, and 25, the underside of the actuator button 52 preferably includes an elongate bead 68 that engages the arm 66 for the above-described movement. Further in this regard, the arm 66 preferably includes a relief or notch 70 (best seen in FIG. 29) that underlies the bead 68 with the rotatable member 42 in the locked position, as shown in FIG. 5, to prevent contact between the bead 68 and the arm 66. As shown in the illustrated embodiment, the actuator button 52 is preferably cantilevered on the shell 46 for movement between the un-actuated and actuated positions, with the actuator button 52 being biased toward the un-actuated position, which in the illustrated embodiment is the as-molded condition or as-formed condition of the exterior housing 40 including the actuator button 52.

Figure 1:
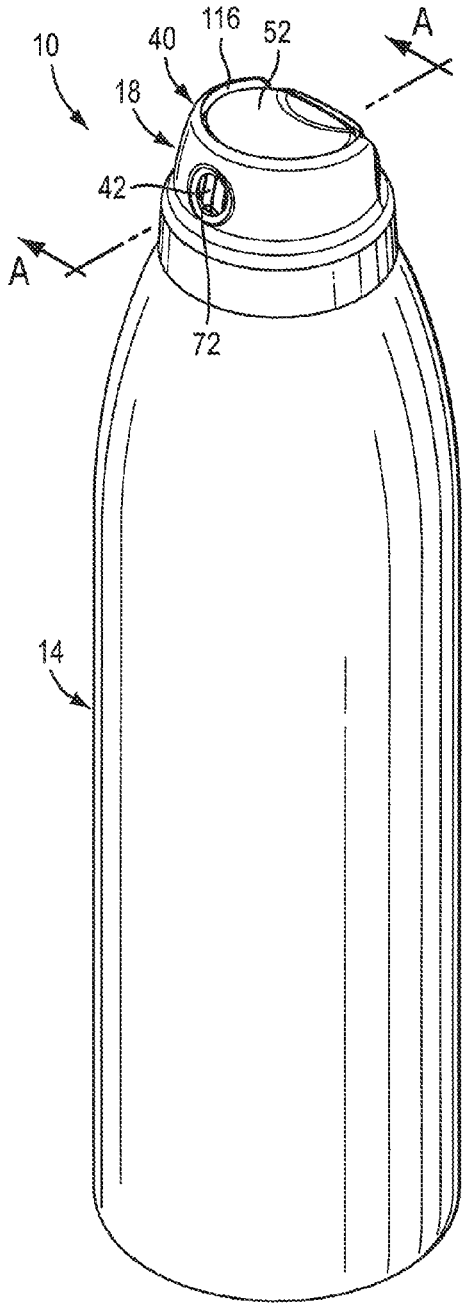
FIG. 1 is an isometric view from the front and above of a hand-held, finger-operable dispensing package that incorporates a dispensing system that includes a valve assembly (not visible in FIG. 1) and a cooperating finger-operable locking actuator installed on a container of pressurized product, with the actuator shown in a locked and un-actuated condition.
Figure 2:
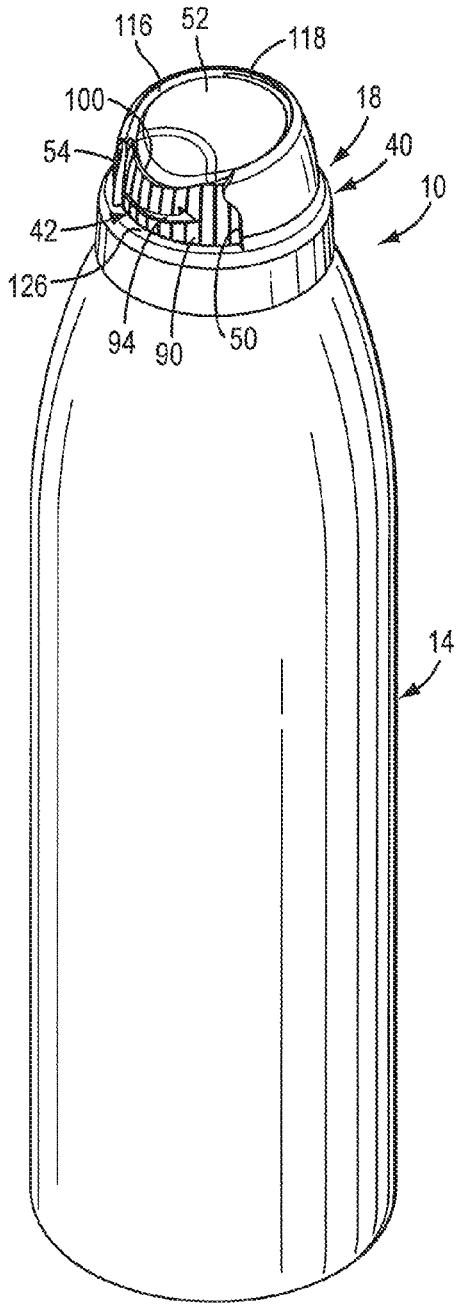
FIG. 2 is an isometric view from the rear and above of the dispensing package and actuator of FIG. 1, again with the actuator shown in the locked and un-actuated condition.
Figure 3:
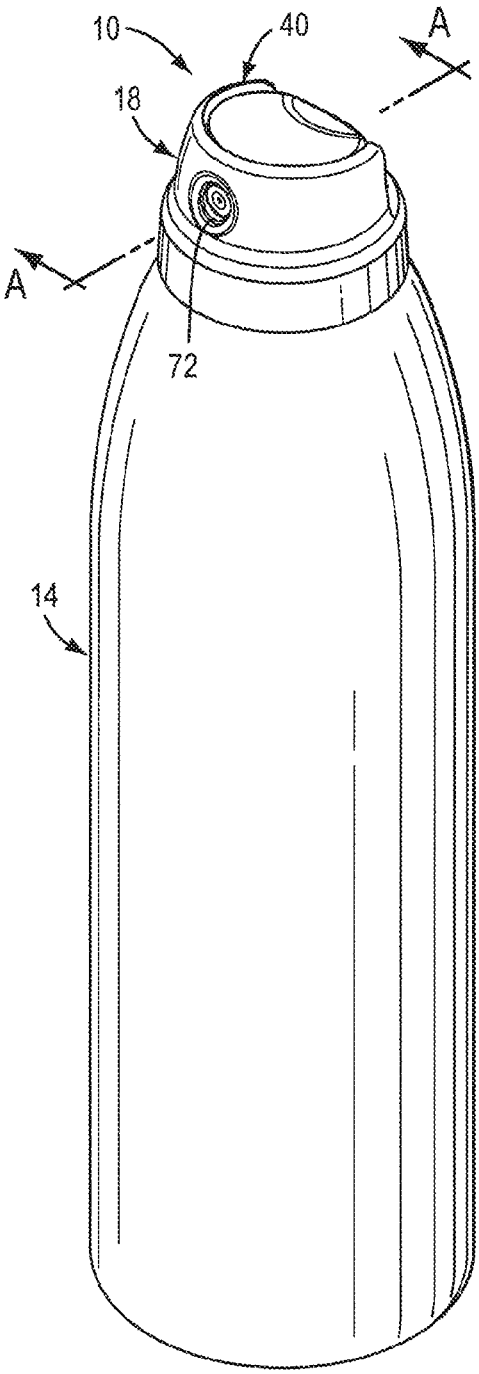
FIG. 3 is a view similar to FIG. 1 but showing the actuator in an unlocked and un-actuated condition.

As best seen in FIGS. 5-8, the shell 46 of the exterior housing 40 preferably has a dispensing port 72 formed therein. The exit port 60 of the flow path 58 is aligned with the dispensing port 72 when the rotatable member 42 is in the un-locked position (FIGS. 3, 4, 6, 7), and circumferentially spaced from the dispensing port 72 when the rotatable member 42 is in the locked position (FIGS. 1, 2, 5). This has the advantage of covering the exit port 60 (and exit orifice 64 if a spray insert 62 is included) when the actuator 18 is in the locked condition, thereby protecting the port 60 (and orifice 64 if included) from debris.

Figure 11:
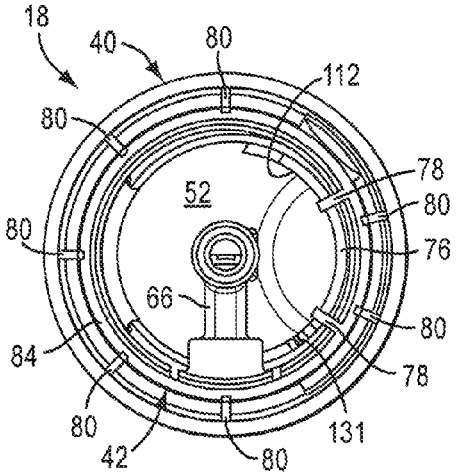
FIG. 11 is a bottom view of the actuator of FIGS. 1-10, with the actuator shown in the locked and un-actuated condition.
Figure 12:
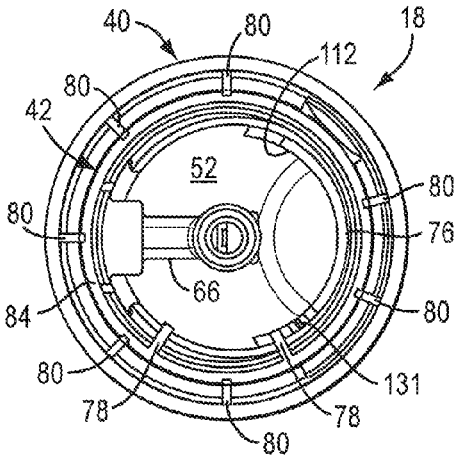
FIG. 12 is a view similar to FIG. 11, but showing the actuator in the unlocked and un-actuated condition.
Figure 13:
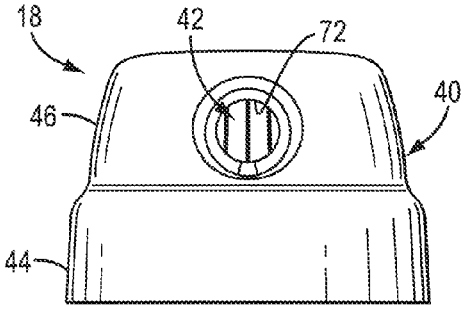
FIG. 13 is a front elevational view of the actuator of FIGS. 1-10, with the actuator shown in the locked and un-actuated condition.
Figure 14:
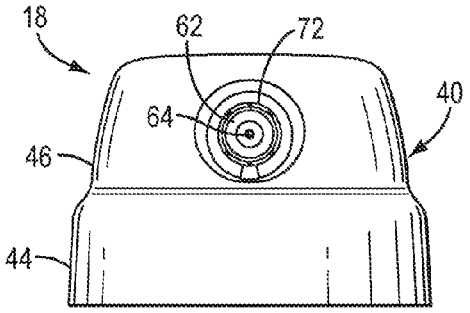
FIG. 14 is a view similar to FIG. 13, but showing the actuator in the unlocked and un-actuated condition.

As best seen in FIG. 5, the rotatable member 42 preferably includes first and second upwardly facing, stop surfaces 74 (only one shown in FIG. 5) that abut a downwardly facing stop surface 76 of the actuator button 52 to prevent movement of the actuator button 52 from the un-actuated position to the actuated position when the rotatable member is in the locked position. Each of the stop surfaces 74 is preferably provided on a corresponding, radially inwardly extending tab or rib 78 (both shown in FIGS. 6, 9 and 29) of the rotatable member 42. The stop surfaces 74 are located on the rotatable member 42 so that they abut the stop surface 76 of the actuator button 52 when the rotatable member 42 is in the locked position (FIG. 5) and so that they do not abut the stop surface 76 when the rotatable member 42 is in the un-locked position (FIGS. 6 and 7). In this regard, the stop surfaces 74 and corresponding ribs 78 of the rotatable member 42 underlie the stop surface 76 of the actuator button 52 when the rotatable member 42 is in the locked position (FIGS. 5 and 11) and are circumferentially spaced from and do not underlie the stop surface 76 when the rotatable member is in the unlocked position (FIGS. 6, 7, and 12).

As best seen in FIGS. 9, 10, 11, 12, and 25, the exterior housing 40 preferably includes a plurality of circumferentially spaced, radially inwardly extending tabs or ribs 80, with each rib 80 having radially inwardly pointed tip 82 that, as shown in FIG. 9, provides a snap fit engagement with a downwardly facing, annular surface 84 of the rotatable member 42. This arrangement allows for the rotatable member 42 to be retained in the interior chamber 48 while also being rotatable relative to the exterior housing 40.

Figure 4:
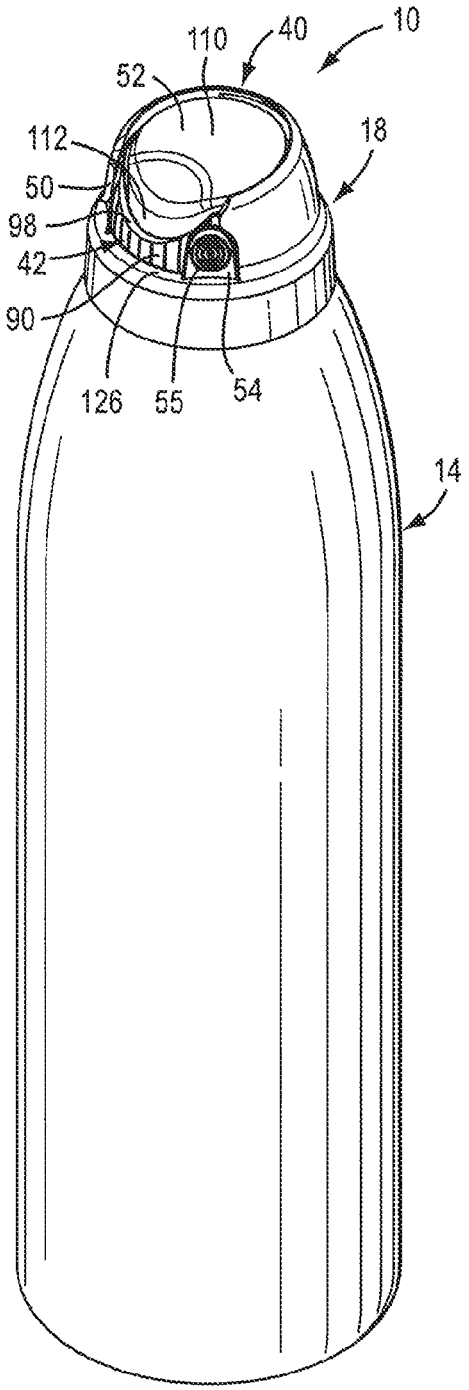
FIG. 4 is a view similar to FIG. 2 but showing the actuator in an unlocked and un-actuated condition.
Figure 26:
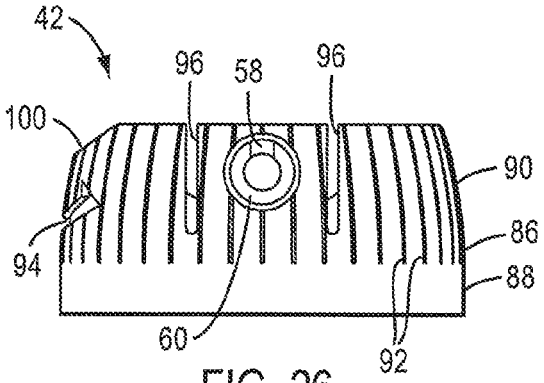
FIG. 26 is a front elevational view of the rotatable member component of the actuator of FIGS. 1-20.
Figure 27:
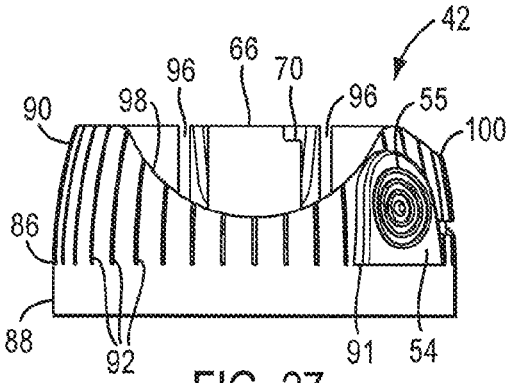
FIG. 27 is a rear elevational view of the rotatable member component.
Figure 28:
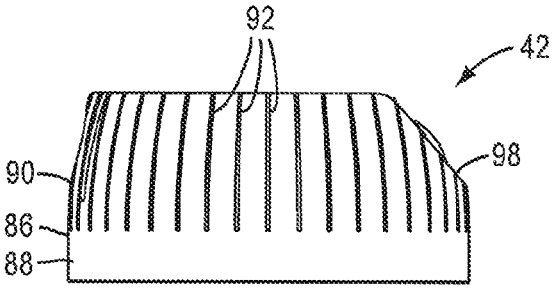
FIG. 28 is a left-side elevational view of the rotatable member component (relative to the rear)
Figure 29:
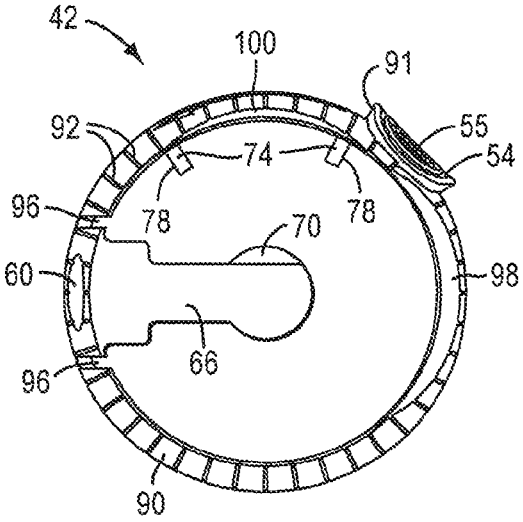
FIG. 29 is a top, plan view of the rotatable member component.
Figure 30:
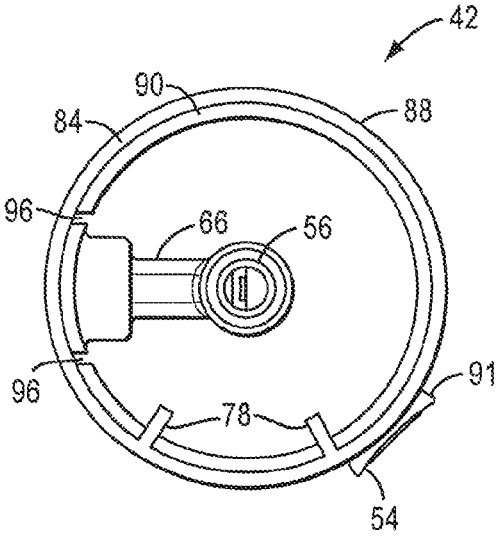
FIG. 30 is a bottom view of the rotatable member component.
Figure 31:
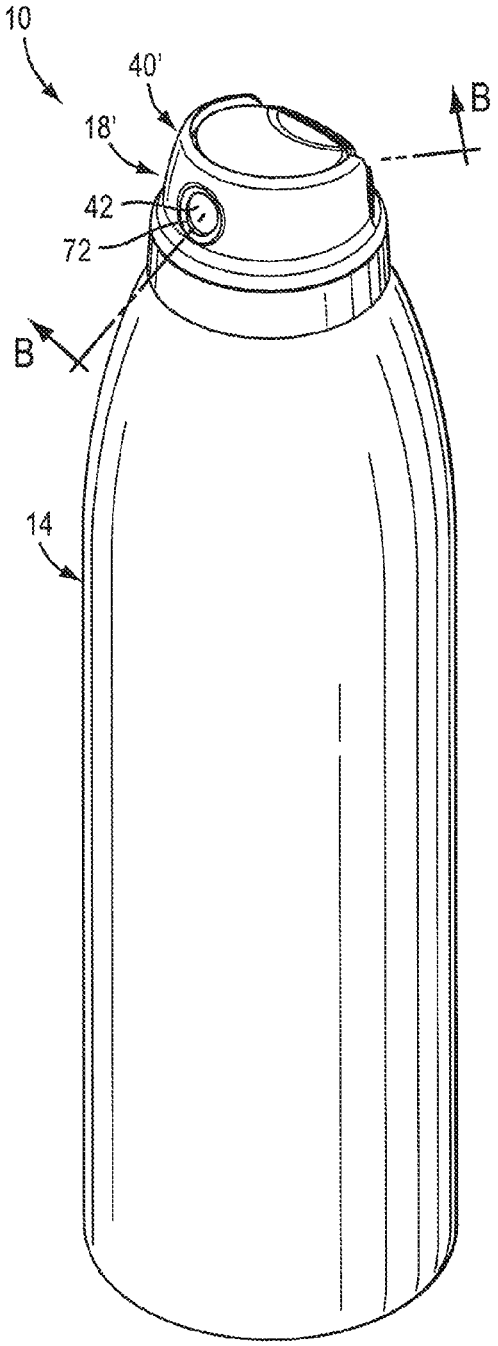
FIG. 31 is an isometric view from the front and above of a hand-held, finger-operable dispensing package similar to FIG. 1 but showing a second embodiment of a cooperating finger-operable locking actuator installed on a container of pressurized product, with the actuator shown in a locked and un-actuated condition.
Figure 32:
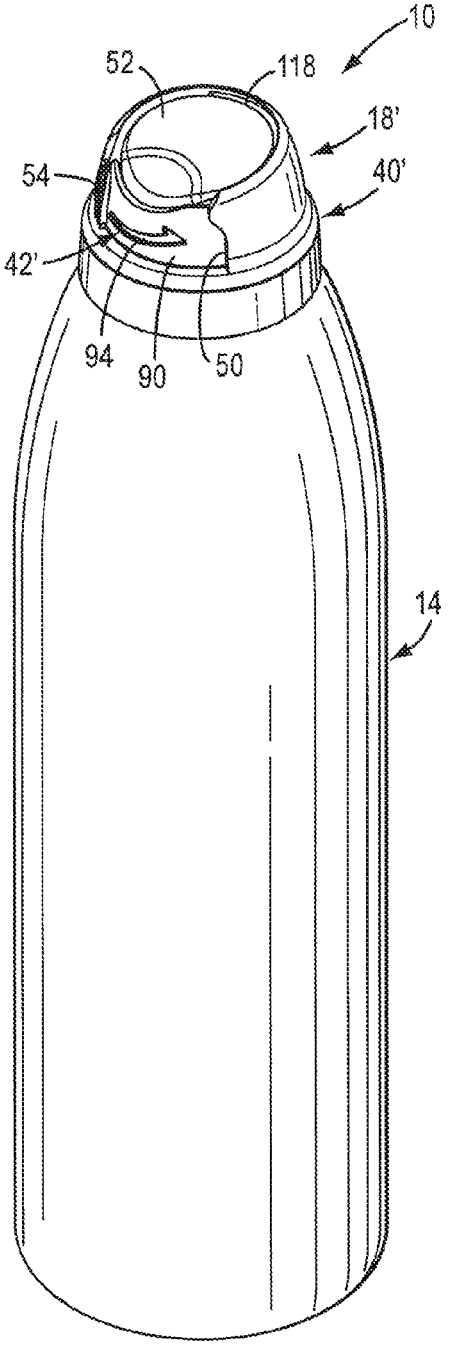
FIG. 32 is an isometric view from the rear and above of the dispensing package and actuator of FIG. 31, again with the actuator shown in the locked and un-actuated condition.
Figure 33:
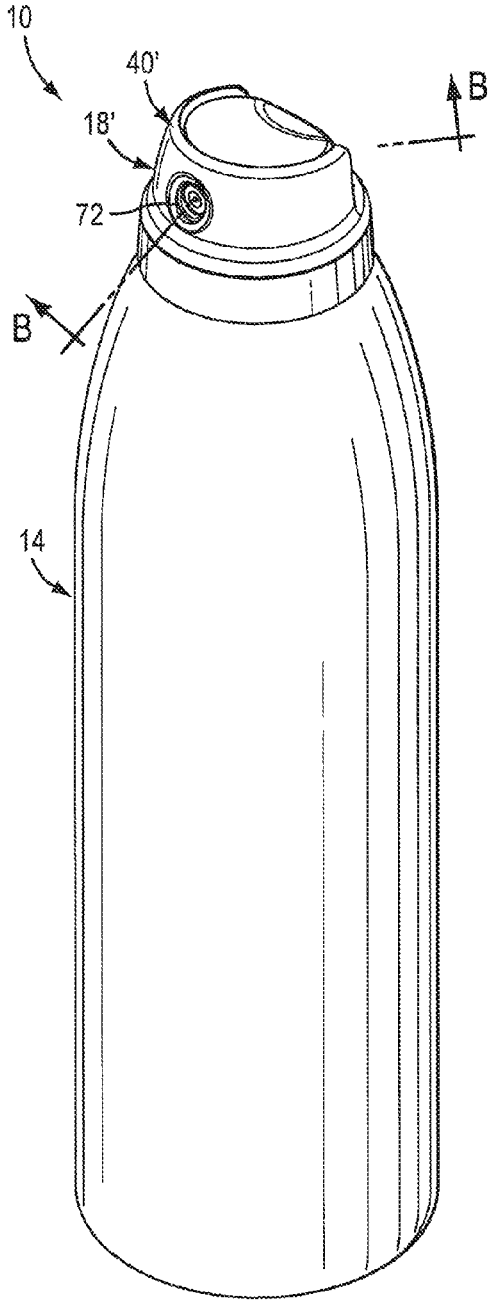
FIG. 33 is a view similar to FIG. 31 but showing the actuator in an unlocked and un-actuated condition.
Figure 34:
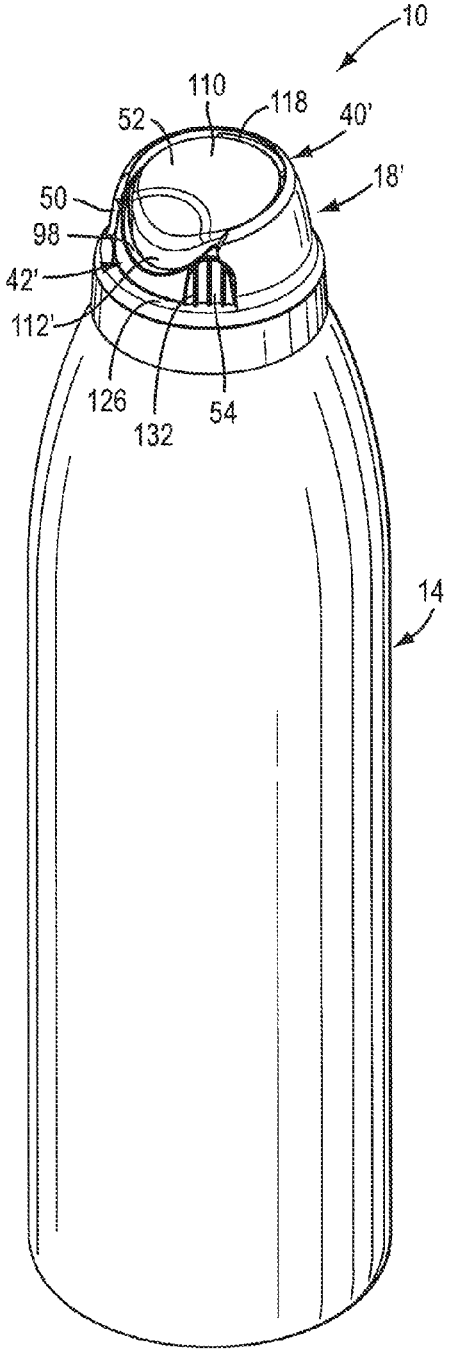
FIG. 34 is a view similar to FIG. 32 but showing the actuator in an unlocked and un-actuated condition.
Figure 35:
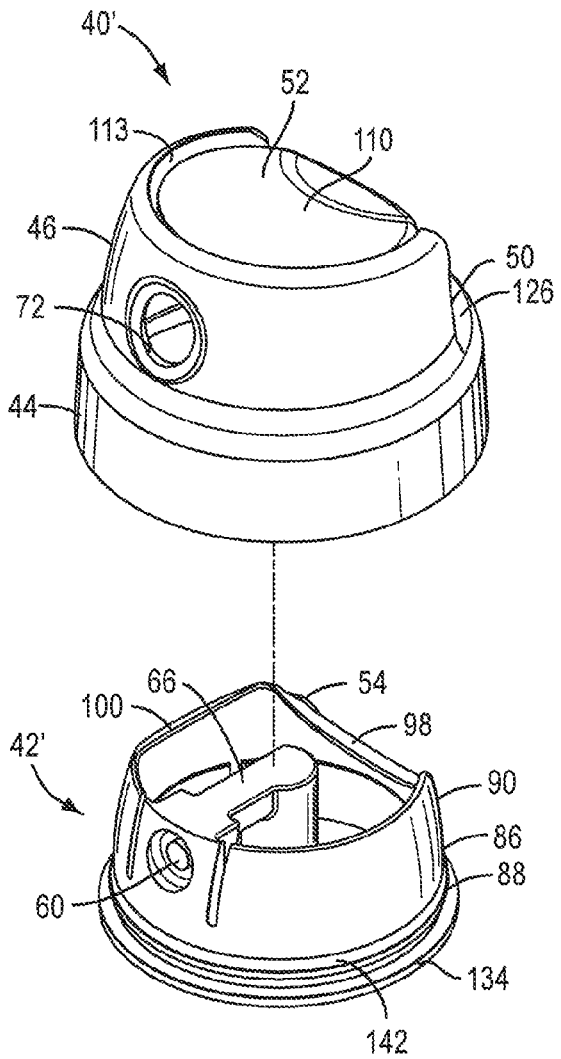
FIG. 35 is an enlarged, exploded isometric view from the front and above showing a shell component and a rotatable member component of the actuator of FIGS. 31-34.

As best seen in FIGS. 26-30, the rotatable member 42 includes an annular wall 86 having lower cylindrical portion 88 and an upper portion 90 that, in the illustrated embodiment, is gently curved radially inwardly as the wall 86 extends upwardly from the cylindrical portion 88. The engageable surface 54 (FIGS. 27 and 29) is provided on a projection 91 extending radially outwardly from an outer surface of the upper portion 90. In the illustrated embodiment, circumferentially spaced, vertical serrations 92 are provided on the outer surface of the upper portion 90. As best seen in FIG. 2, in the illustrated embodiment, a directional indicium in the form of a relieved, swooping arrow 94 is also provided on the outer surface of the upper portion 90 to provide instructional information to a user for movement of the rotatable member 42 from the locked position to the unlocked position. As best seen in FIGS. 26, 27, and 29, in the illustrated embodiment, a pair of vertical slots 96 are provided in the upper portion 90 on either side of cantilevered arm 66 to reduce the force required to move the cantilevered arm 66 from the neutral position (FIGS. 5, 6) to the actuating position (FIG. 7). As best seen in FIG. 4, a curved relief 98 is also provided in the upper portion 90 to provide better user access for movement of the actuator button 52 from the un-actuated position to the actuated position. As best seen in FIG. 2, another curved relief 100, smaller than the curved relief 98, is provided in the upper portion 90 to generally conform the shape of the upper portion 90 to the adjacent portion of the actuator button 52 when the rotatable member is in the locked position.

Figure 22:
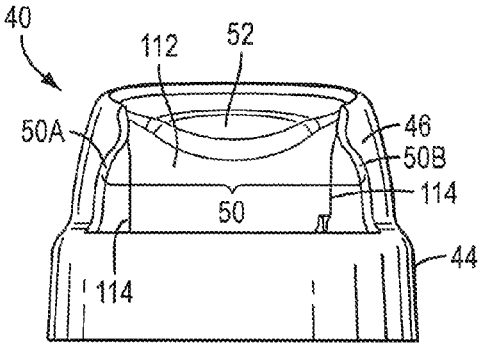
FIG. 22 is a rear elevational view of the shell component.
Figure 23:
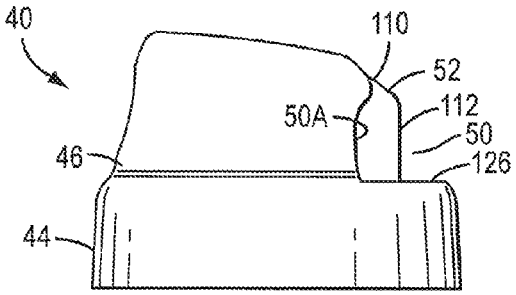
FIG. 23 is a left-side elevational view of the shell component (relative to the rear)
Figure 24:
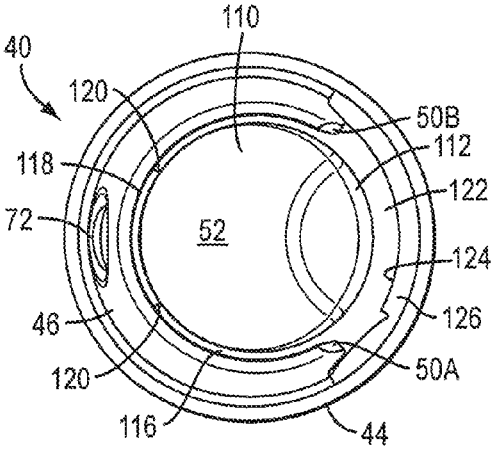
FIG. 24 is a top plan view of the shell component.

As best seen in FIGS. 4-7 and 22-24, the actuator button 52 includes an upper wall 110 that is generally circular when viewed from above and a vertical extending wall 112 that extends downwardly from the upper wall 110 into the interior chamber 48 and terminates at the stop surface 76. In the illustrated embodiment, the wall 112 has a curved shape extending between circumferentially spaced, generally vertical side edges 114, as best seen in FIG. 22. As best seen in FIGS. 24 and 25, the majority of the actuator button 52 is spaced from the remainder of the shell 46 by a gap 116, with a forward portion of the actuator button 52 being joined to the shell 46 by an arcuate shaped bridge 118 that extends radially across the gap 116 and circumferentially between spaced side edges 120. The gap 116 widens to a slot 122 that is partially defined by the window 50, partially defined by the wall 112, and partially defined by an edge surface 124 of a radially inwardly extending horizontal lip 126 of the exterior housing 40. Preferably, the edge surface 124 has a shape that generally conforms to the outermost peripheral shape of the engagable surface 54 and the upper portion 90 of the wall 86 on the rotatable member 42. However, depending upon the resiliency of the exterior housing 40 adjacent the slot 122, in some embodiments it may not be necessary to conform the shape of the edge surface 124 to the outermost peripheral shape of the engageable surface 54. The shape of the slot 122 allows the upper portion 90 of the wall 86, including the engageable surface 54, to be inserted between the wall 112 of the actuator button 52 and the edge surface 124 of the lip 126 during assembly of the rotatable member 42 into the interior chamber 48 so that the engageable surface 54 and a circumferential length of the upper portion 90 of the wall 86 are located in the circumferentially extending window 50 of the shell 46, as best seen in FIGS. 5-7 and 15-20.

Figure 39:
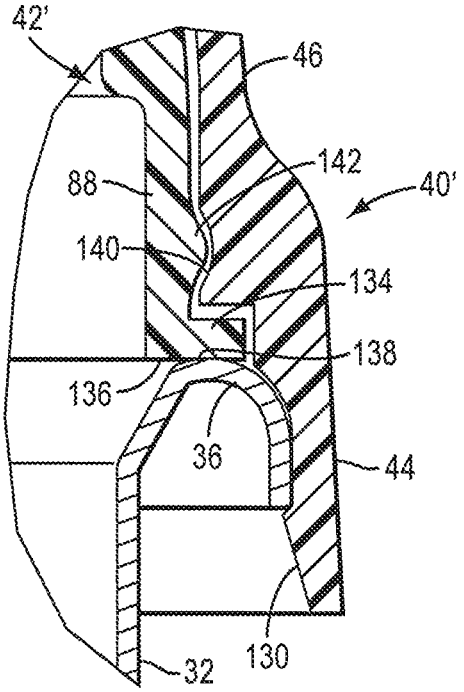
FIG. 39 is a further enlarged, partial cross-sectional view showing a snap fit connection between the shell and the rotatable member components, with the container not shown for ease of illustration.

As best seen in FIGS. 5-7 and 9, the base 44 of the exterior housing 40 includes an annular snap locking feature 130 that secures the base 44 and the rest of the actuator 18 to the container 14 and valve 16 combination so as to prevent, or at least inhibit, (1) removal of the actuator 18 from the container 14 and valve 16 combination, and (2) rotation of the exterior housing 40 relative to the container 14 and valve 16 combination during normal use, handling, storage, and shipping. FIGS. 10 and 39 show the snap locking feature 130 in connection with a cup 32 having its outer peripheral portion 36 shown in an alternate configuration after attachment to a container 14 (container 14 not shown in FIGS. 10 and 39). It will be appreciated that there are many suitable constructions for securing the base 44 to the container 14 and valve 16 combination, and that any such construction may be used for the actuator 18.

In the illustrated embodiment of the actuator 18, a user will hear a pair of sequenced, audible snapping or clicking sounds as an indication that the unlocked (or locked) position has been reached. A tactile sensation of a pair of sequenced increases and decreases in resistance to the rotation of the rotatable member 42 is also sensed by the user. The pair of sequenced audible clicks or snaps, along with the pair of resistance changes, are produced by a cantilevered, resilient tang 131 (best seen in FIG. 5) extending downwardly from the wall 112 of the actuator button 52. The two ribs 78 on the rotatable member 42 contact the tang 131 in sequence as the rotatable member 42 is rotated between the locked and unlocked positions and the resulting deflections of the tang 131 produce the audible clicks or snaps and the tactile sensation.

FIGS. 31-51 illustrate another embodiment or modification of the actuator 18, with like reference numbers indicating like features or components and with 18', 40', and 42' indicating the modified actuator 18', exterior housing 40', and rotatable member 42' of FIGS. 31-51 rather than the actuator 18, exterior housing 40, and rotatable member 42 of FIGS. 1-30, respectively. As best seen in FIGS. 32, 34, 43-45, and 48-50, the actuator 18' differs cosmetically from the actuator 18 in that the vertical serrations 92 have been removed from the upper portion 90 of the wall 86 of the rotatable member 42', and the circular beads 55 on the engagable surface 54 have been replaced with a series of vertically extending beads 132.

As best seen in FIGS. 36-41, the actuator 18' differs functionally from the actuator 18 of FIGS. 1-30 in that the lower portion 88 of the wall 86 of the rotatable member 42' has been extended downward and provided with a an annular shoulder 134 having a downwardly facing, annular surface 136 than abuts an upwardly facing, annular surface 138 of the container 14 and valve 16 combination. This structure allows for the rotatable member 42' to rotate relative to the exterior housing 40' while providing an additional load path from the actuator 18 to the container 14 and valve 16 combination by transmitting loads through the rotatable member 42' directly to the container 14 and valve 16 combination rather than from the rotatable member 42 through the exterior housing 40 and then to the container 14 and valve 16 combination as in the actuator 18 of FIGS. 1-30. This feature provides a robust structure for the actuator 18'.

Figure 36:
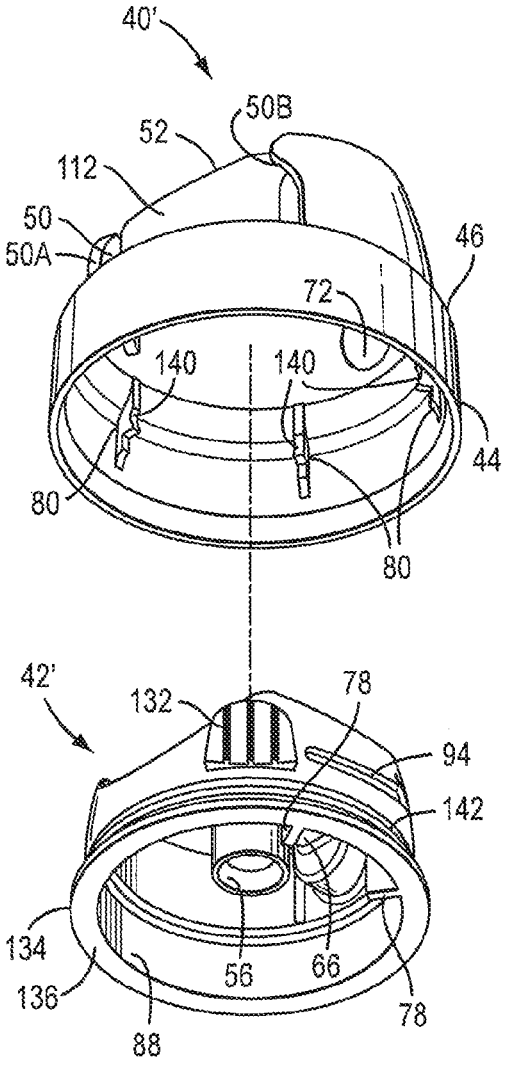
FIG. 36 is an enlarged, exploded isometric view from the rear and below showing the actuator components of FIG. 35.
Figure 37:
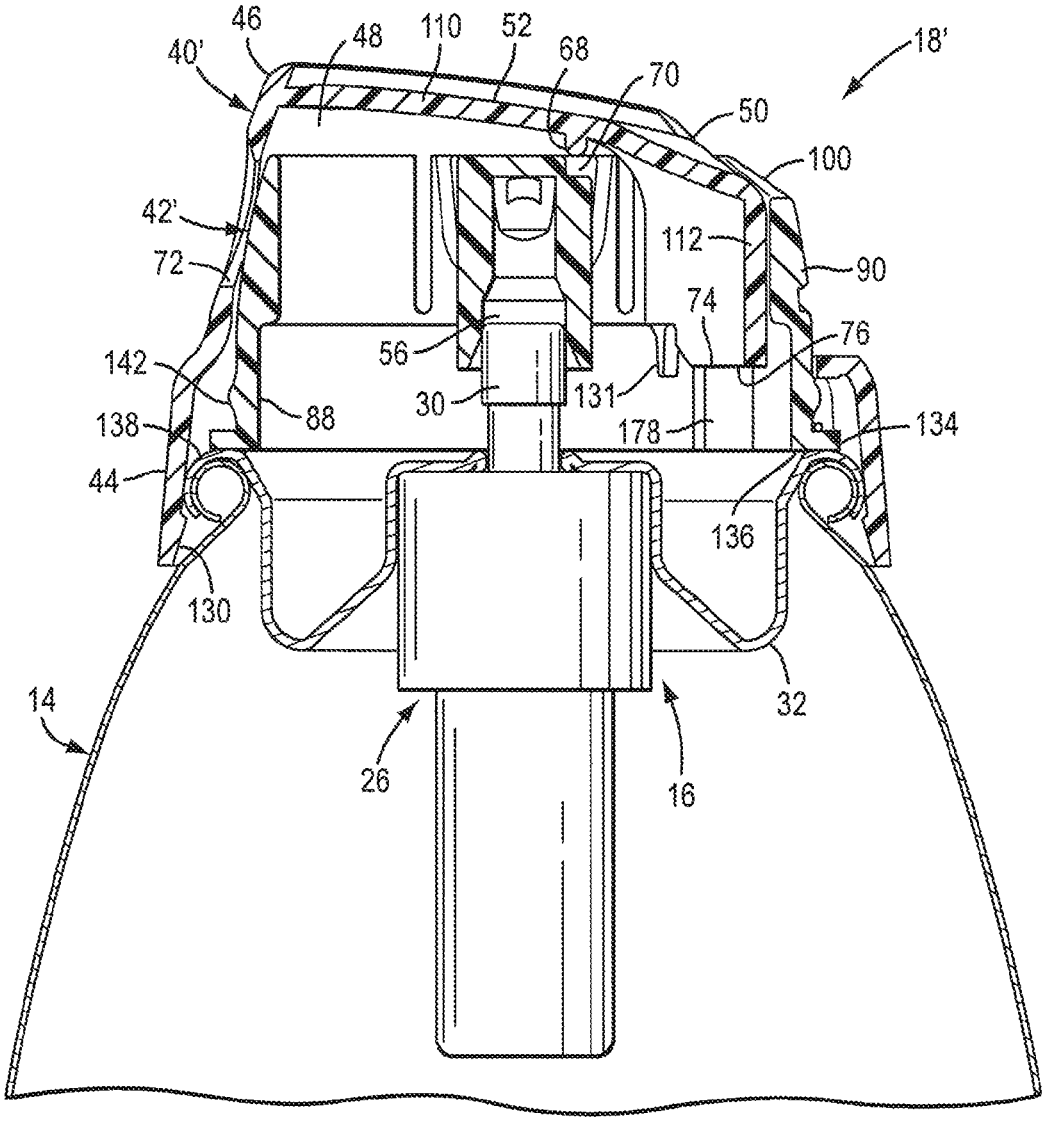
FIG. 37 is an enlarged, fragmentary, cross-sectional view taken along line A-A in FIG. 31, with a diagrammatic representation of a valve body of the dispensing system, and showing the dispensing system in the locked condition preventing actuation.
Figure 38:
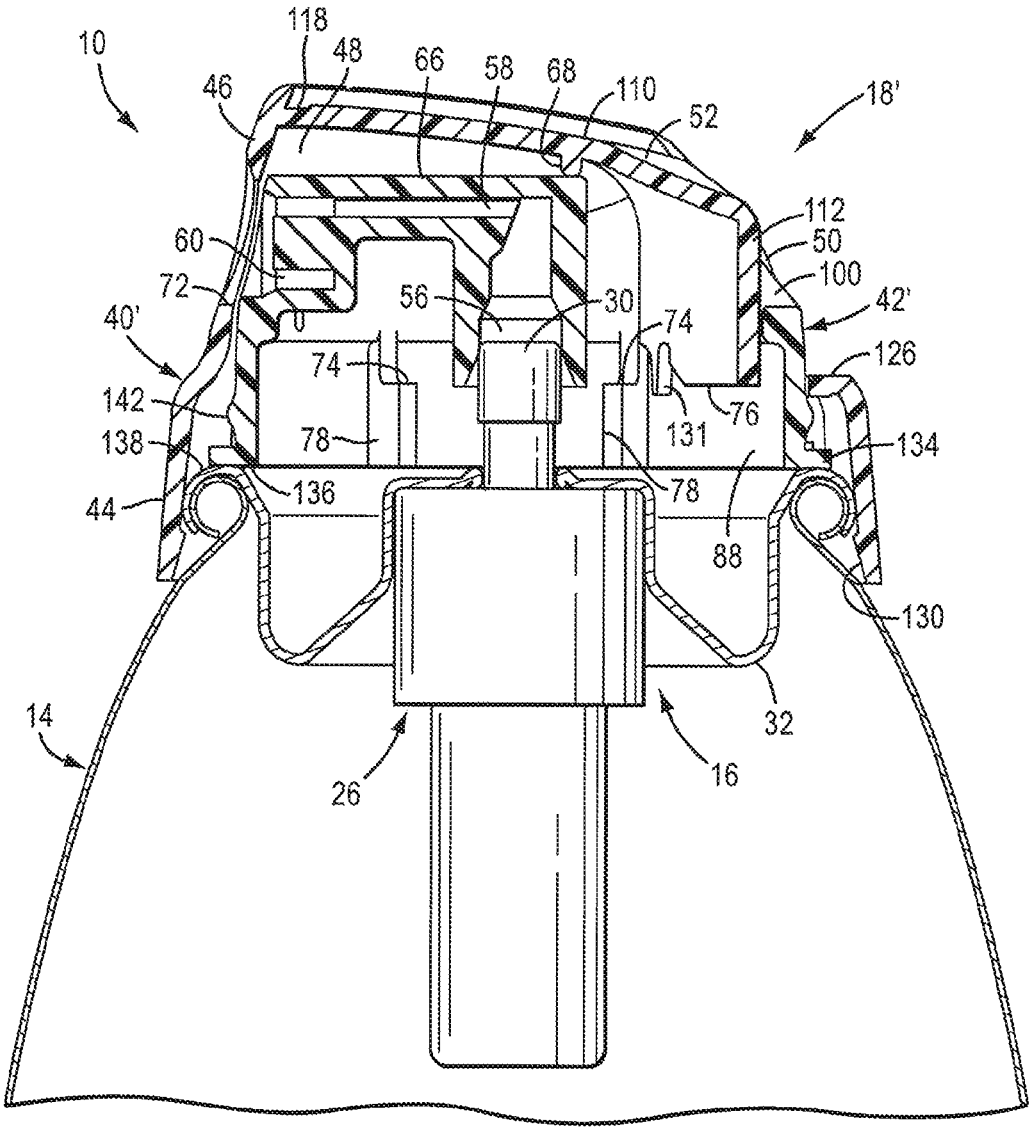
FIG. 38 is an enlarged, fragmentary, cross-sectional view taken along line A-A in FIG. 32, again with the diagrammatic representation of the valve body, and showing the dispensing system in the unlocked condition permitting actuation.
Figure 52:
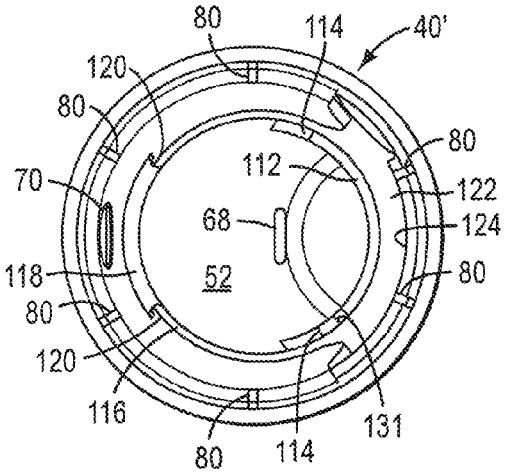
FIG. 52 is a bottom view of the exterior housing component of the actuator of FIGS. 31-46.

As best seen in FIGS. 36 and 39, the snap fit connection between the exterior housing 40' and the rotatable member 42' of the actuator 18' also differs from the snap fit connection provided by the radially inwardly pointed tips 82 and downwardly facing, annular surface 84 of the exterior housing 40 and rotatable member 42, respectively, in the actuator 18 of FIGS. 1-30. In this regard each of the ribs 80 of the exterior housing 40' is provided with a curved, concave relief 140 that provides a snap fit engagement with a curved, convex, annular bead 142 on the lower portion 88 of the wall 86 of the rotatable member 42'. As seen in FIG. 52, rather than the seven ribs 80 of the exterior housing 40 of the embodiment of FIGS. 1-30, the exterior housing 40' is provided with six ribs 80 with circumferential locations that differ from the circumferential locations of the ribs 80 of the housing 40 of FIGS. 1-30. This snap fit connection accommodates the previously described engagement between the annular shoulder 134 and surface 136 of the rotatable member 42' while allowing the rotatable member 42' to rotate relative to the exterior housing 40'. It should be noted that this modification to the ribs 80 is the only difference between the exterior housing 40' of FIGS. 31-51 and the exterior housing 40' of FIGS. 1-30.

Figure 40:
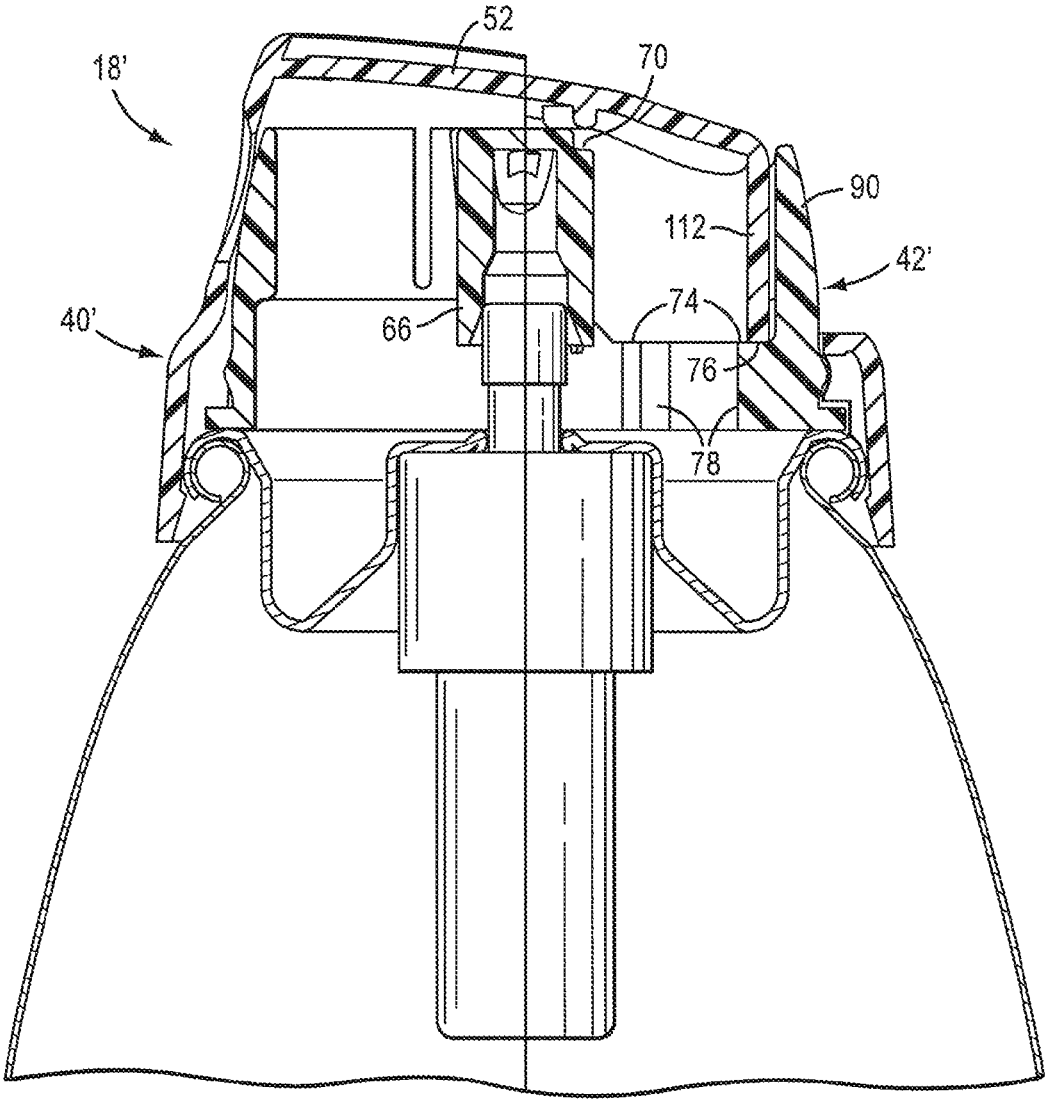
FIG. 40 is an enlarged cross-sectional view taken along line B-B in FIG. 31 showing the actuator in the locked and un-actuated condition.
Figure 41:
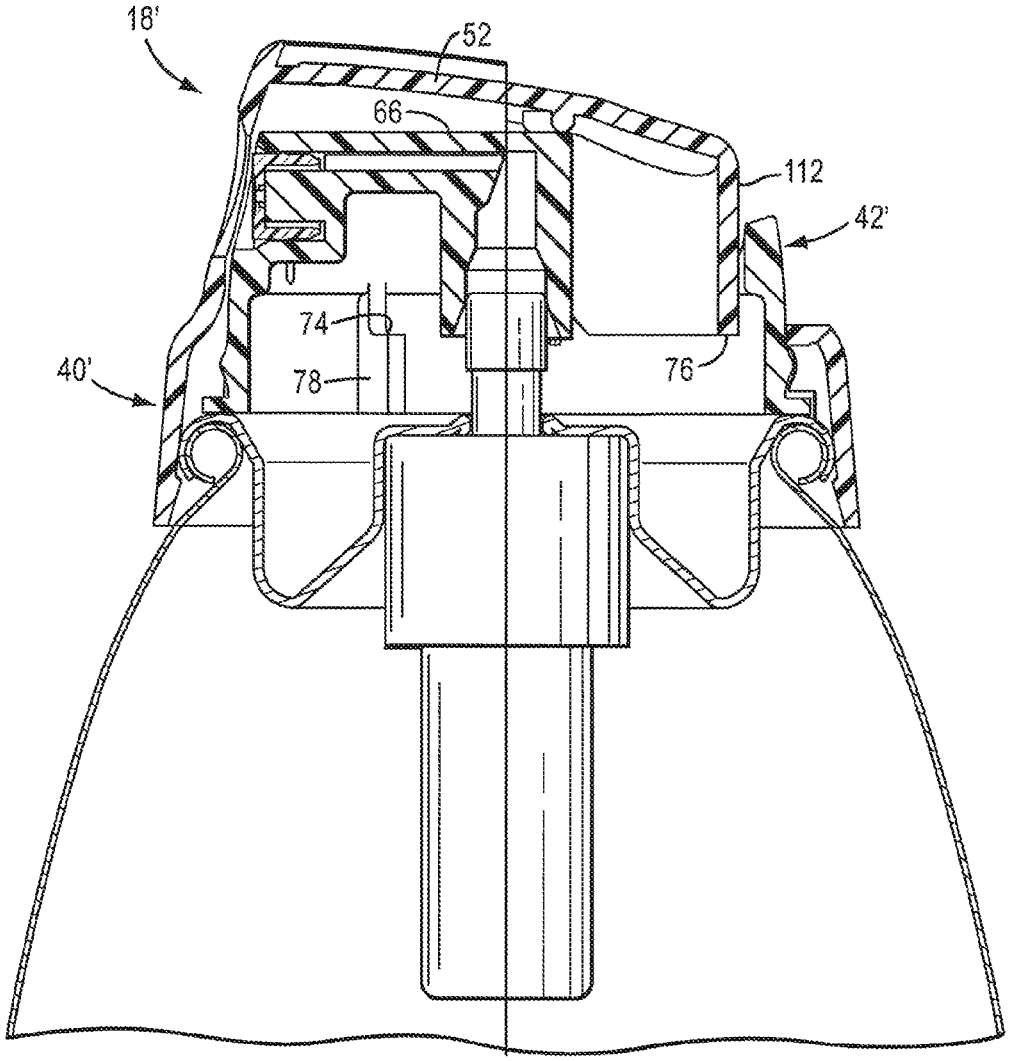
FIG. 41 is a view similar to FIG. 40, but taken along line B-B in FIG. 33 to show the actuator in the unlocked and un-actuated condition.
Figure 42:
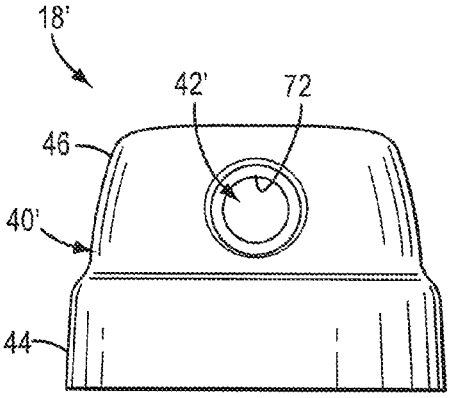
FIG. 42 is a front elevational view of the actuator of FIGS. 31-41, with the actuator shown in the locked and un-actuated condition.
Figure 43:
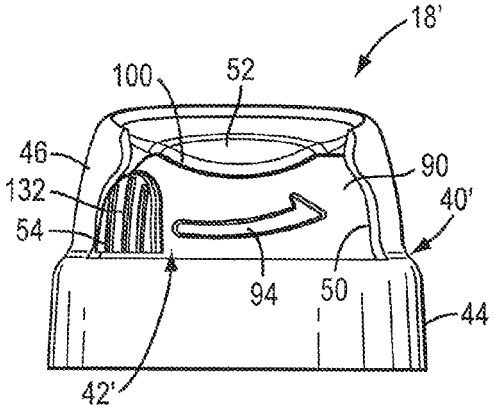
FIG. 43 is a rear elevational view of the actuator of FIGS. 31-41, with the actuator shown in the locked and un-actuated condition.
Figure 44:
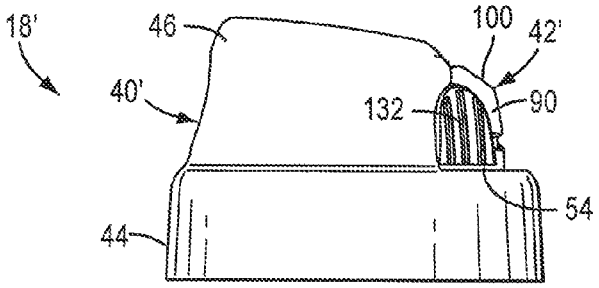
FIG. 44 is a left-side elevational view of the actuator of FIGS. 31-41 (relative to the rear), with the actuator shown in the locked and un-actuated condition.
Figure 45:
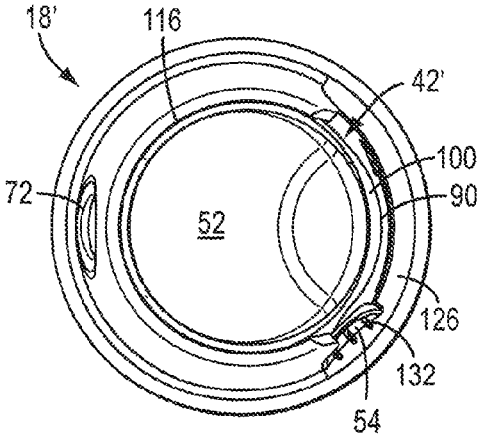
FIG. 45 is a top plan view of the actuator of FIGS. 31-41, with the actuator shown in the locked and un-actuated condition.
Figure 46:
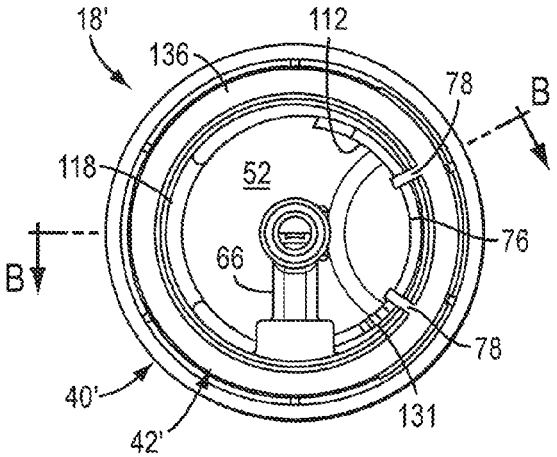
FIG. 46 is a bottom view of the actuator of FIGS. 31-41, with the actuator shown in the locked and un-actuated condition.
Figure 47:
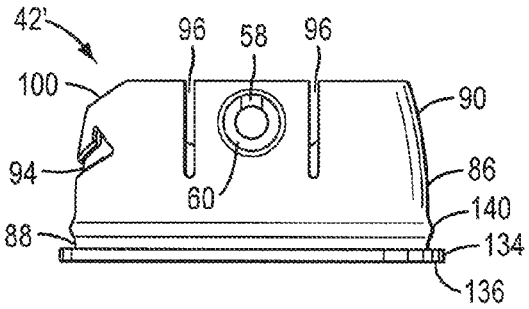
FIG. 47 is a front elevational view of the rotatable member component of the actuator of FIGS. 31-46.
Figure 48:
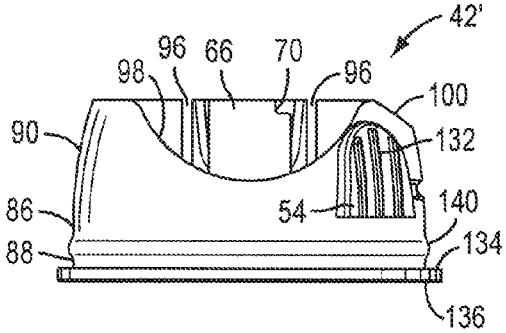
FIG. 48 is a rear elevational view of the rotatable member component of FIG. 47.
Figure 49:
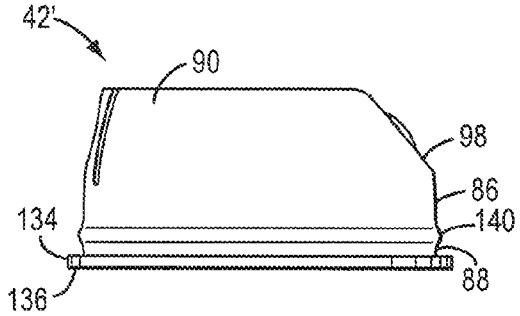
FIG. 49 is a left-side elevational view of the rotatable member component of FIG. 47 (relative to the rear)
Figure 50:
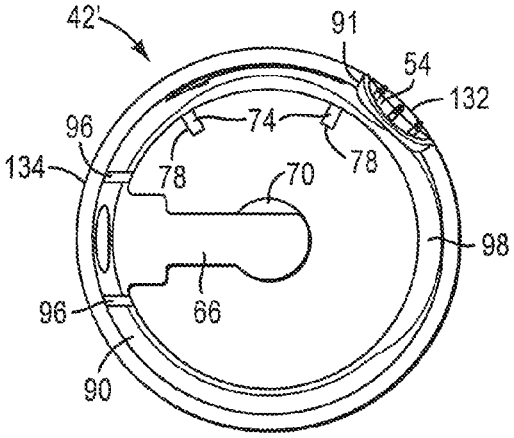
FIG. 50 is a top, plan view of the rotatable member component of FIG. 47.
Figure 51:
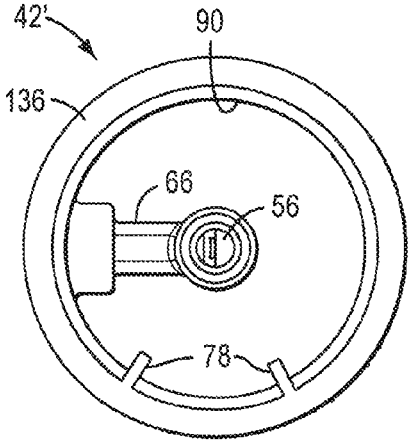
FIG. 51 is a bottom view of the rotatable member component of FIG. 47.

The interaction between the stop surfaces 74 and 76 is further illustrated in FIGS. 40 and 41, which are section views taken along a line B-B (FIGS. 31, 33, 46) that sections one of the ribs 78 with the rotatable member 42' in the locked position. FIG. 40 shows how the stop surfaces 74 and 76 engage each other when the ribs 78 underlying the stop surface 76 with the rotatable member 40' in the locked position. FIG. 41 shows how the stop surfaces 74 and 76 do not engage each other when the ribs 78 do not underlie the stop surface 76 with the rotatable member 40' in the un-locked position.

Preferably, each of the components 40, 40', 42, and 42' is a one-piece molded component of a suitable material that provides the necessary structural stability and strength together with the necessary local, temporary, elastic deformation required for operation and assembly of the component. Such materials are preferably those in the olefin family (e.g., polypropylene, polyethylene, etc.) or in the engineering grade plastics family (i.e., nylon, acetyl, etc.). However, it should be noted that other materials may be desired depending upon the particular application for the actuators 18, 18', and further that constructions other than a one-piece molded component are possible for each of the components 40, 40', 42, and 42'. For example, and without any limitation, it is possible that the actuator button 52 could be a separate piece that is assembled to the remainder of the exterior housing 40, 40', or that the base 44 could be a separate piece that is assembled to the rest of the exterior housing 40, 40', or that the arm 66 is a separate piece that may or may not rotate with the remainder of the rotatable housing 42, 42', or that the engagable surface 54 is part of a separate piece that is assembled to the remainder of the rotatable housing 42, 42'. It should be understood that other examples are possible and the foregoing list is not intended to be exhaustive.

It should further be understood that other possible modifications to the exterior housing 40, 40' and rotatable member 42, 42' are contemplated. For example, in some embodiments, it may be desirable to forego any snap fit connection between the exterior housing 40, 40' and rotatable member 42, 42' and simply trap the rotatable member 42, 42' between the exterior housing 40, 40' and the container 14 and valve 16 combination. As a further example in this regard, it may be desirable to extend the lower portion 88 of the wall 86 of the rotatable member 42, 42' downwardly into the annular channel defined between the mounting flange 34 and the inner wall 38 of the valve mounting cup 32, with a snap fit connection provided between the cup 32 and the lower portion 88 of the rotatable member 40, 40'.

In operation, a user can grasp the dispensing package 10 in their hand and using a single finger, or more than a single finger if desired, to engage the engageable surface 54 and rotate the rotatable member 42, 42' in a counterclockwise direction from the locked position to the unlocked position. The user may then use the same finger or fingers, or a different finger or fingers, to actuate the actuator button 52 in the downward direction, which in turn deflects the arm 66 in the downward direction to initiate a dispensing of the fluent product from the valve 16. After the desired amount of fluent product is dispensed, the user can release the actuator button 52 which returns to its un-actuated position allowing the arm 66 to return to its neutral position to terminate the dispensing of the fluent product from the valve 16. The user can then engage the engageable surface 54 and rotate the rotatable member 42, 42' in a clockwise direction from the un-locked position to the locked position. It should be appreciated that the actuator 18, 18' could be easily modified so that the rotatable member 42, 42' is rotated in a clockwise direction from the locked position to the unlocked position, rather than counterclockwise as in the illustrated embodiments.

What is claimed is:

1. An actuator (18, 18') for actuating a valve (16) on a container (14) for dispensing a fluent product, the actuator (18, 18) comprising:

an exterior housing (40, 40') having a base (44) to secure the actuator (18, 18') to the container, and a shell (46) defining an interior chamber (48), a circumferentially extending window (50) extending between the interior chamber (48) and an exterior of the shell (46), and an actuator button (52) movable between an un-actuated position and an actuated position; and a rotatable member (42, 42') located in the interior chamber (48) to rotate relative to the exterior housing (40, 40') between a locked position wherein movement of the actuator button (52) from the un-actuated position to the actuated position is prevented and an unlocked position wherein movement of the actuator button (52) from the un-actuated position to the actuated position is allowed to actuate the valve, the rotatable member (42, 42') having an engageable surface (54) located in the circumferentially extending window (50) to be engaged by a user for movement of the engageable surface (54) within said window (50) between a first position corresponding to the locked position and a second position corresponding to the unlocked position, wherein the rotatable member (42, 42') includes:

a stem pocket (56) to receive an outwardly projecting, movable, fluent product-dispensing stem (30) of the valve (16); and a flow path (58) to direct fluent product from the stem pocket (56) to an exterior of the actuator (18, 18').

2. The actuator (18, 18') of claim 1 wherein the shell (46) has a dispensing port (72) and the flow path (58) has an exit port (60) that is aligned with the dispensing port (72) when the rotatable member (42, 42') is in the unlocked position and circumferentially spaced from the dispensing port (72) when the rotatable member (42, 42') is in the locked position.

3. The actuator (18, 18') of claim 1 wherein the rotatable member (42, 42') further includes a cantilevered arm (66) with the stem pocket (56) and the flow path (58) defined therein, the arm (66) movable between a neutral position wherein the stem pocket (56) is located so as not to actuate the valve (16) and an actuating position wherein the stem pocket (56) is located to actuate the valve (16) to dispense a fluent product.

4. The actuator (18, 18') of claim 3 wherein the arm (66) is biased toward the neutral position.

5. The actuator (18, 18') of claim 3 wherein the actuator button (52) overlies at least part of the cantilevered arm (66) and engages the arm (66) to move the arm (66) from the neutral position to the actuating position when the rotatable member (42, 42') is in the unlocked position and the actuating button (52) moves from the un-actuated position to the actuated position.

6. The actuator (18, 18') of claim 5 wherein the actuator button (52) is biased toward the un-actuated position.

7. An actuator (18, 18') for actuating a valve (16) on a container (14) for dispensing a fluent product, the actuator (18, 18) comprising:

an exterior housing (40, 40') having a base (44) to secure the actuator (18, 18') to the container, and a shell (46) defining an interior chamber (48), a circumferentially extending window (50) extending between the interior chamber (48) and an exterior of the shell (46), and an actuator button (52) movable between an un-actuated position and an actuated position; and a rotatable member (42, 42') located in the interior chamber (48) to rotate relative to the exterior housing (40, 40') between a locked position wherein movement of the actuator button (52) from the un-actuated position to the actuated position is prevented and an unlocked position wherein movement of the actuator button (52) from the un-actuated position to the actuated position is allowed to actuate the valve, the rotatable member (42, 42') having an engageable surface (54) located in the circumferentially extending window (50) to be engaged by a user for movement of the engageable surface (54) within said window (50) between a first position corresponding to the locked position and a second position corresponding to the unlocked position, wherein the rotatable member (42, 42') has a snap fit engagement with the exterior housing (40, 40').

8. An actuator (18, 18') for actuating a valve (16) on a container (14) for dispensing a fluent product, the actuator (18, 18) comprising:

an exterior housing (40, 40') having a base (44) to secure the actuator (18, 18') to the container, and a shell (46) defining an interior chamber (48), a circumferentially extending window (50) extending between the interior chamber (48) and an exterior of the shell (46), and an actuator button (52) movable between an un-actuated position and an actuated position; and a rotatable member (42, 42') located in the interior chamber (48) to rotate relative to the exterior housing (40, 40') between a locked position wherein movement of the actuator button (52) from the un-actuated position to the actuated position is prevented and an unlocked position wherein movement of the actuator button (52) from the un-actuated position to the actuated position is allowed to actuate the valve, the rotatable member (42, 42') having an engageable surface (54) located in the circumferentially extending window (50) to be engaged by a user for movement of the engageable surface (54) within said window (50) between a first position corresponding to the locked position and a second position corresponding to the unlocked position, wherein the rotatable member (42, 42') further comprises a surface (136) located to contact a surface (138) of at least one of said valve (16) and container (14) in at least the locked position of the rotatable member (42, 42').

* * * * *